US005118987A

United States Patent [19]

Leksell et al.

[11] Patent Number: 5,118,987

[45] Date of Patent: Jun. 2, 1992

[54] MULTI-LAYER STRUCTURE AND METHOD OF CONSTRUCTING THE SAME FOR PROVIDING TFEL EDGE EMITTER MODULES

[75] Inventors: David Leksell, Oakmont; Zoltan K. Kun, Churchill Boro; Juris A. Asars, Murrysville Boro, all of Pa.; William A. Barrow, Beaverton; Carl W. Laakso, Portland, both of Oreg.

[73] Assignee: Westinghouse Electric Corp., Pittsburgh, Pa.

[21] Appl. No.: 434,397

[22] Filed: Nov. 13, 1989

[51] Int. Cl.[5] ..... H05B 33/02; H05B 33/10

[52] U.S. Cl. ..... 313/505; 313/506; 315/169.3; 427/66

[58] Field of Search ..... 313/505, 506; 315/169.3; 427/66

[56] References Cited

U.S. PATENT DOCUMENTS 5,004,556 4/1991 Kun et al. ..... 315/169.3

*Primary Examiner*—Sandra L. O'Shea

*Attorney, Agent, or Firm*—John K. Williamson

[57] ABSTRACT

A TFEL structure has a multi-layer construction which includes a bottom substrate layer, a lower electrode layer, a middle EL stack, and an upper electrode layer. Forward portions of the EL stack and the lower and upper electrode layers have formed therethrough a series of longitudinal channels and a transverse street connecting the channels and extending along a forward edge of the bottom substrate layer so as to define a plurality of pixels having light-emitting front edges setback from the forward edge of the bottom substrate layer by the width of the street. Rearward portions of the lower and upper electrode layers respectively underlie and overlie a rearward portion of the EL stack but not each other so as to electrically isolate the rearward portions of the lower and upper electrode layers from one another. Also, a bus bar layer overlies the rearward portion of the EL stack and crosses the rearward portion of the upper electrode layer. An insulation layer is interposed between the rearward portions of the bus bar layer and upper electrode layer. Selected portions of the bus bar layer and upper electrode layer are electrically connected together through the insulation layer.

27 Claims, 17 Drawing Sheets

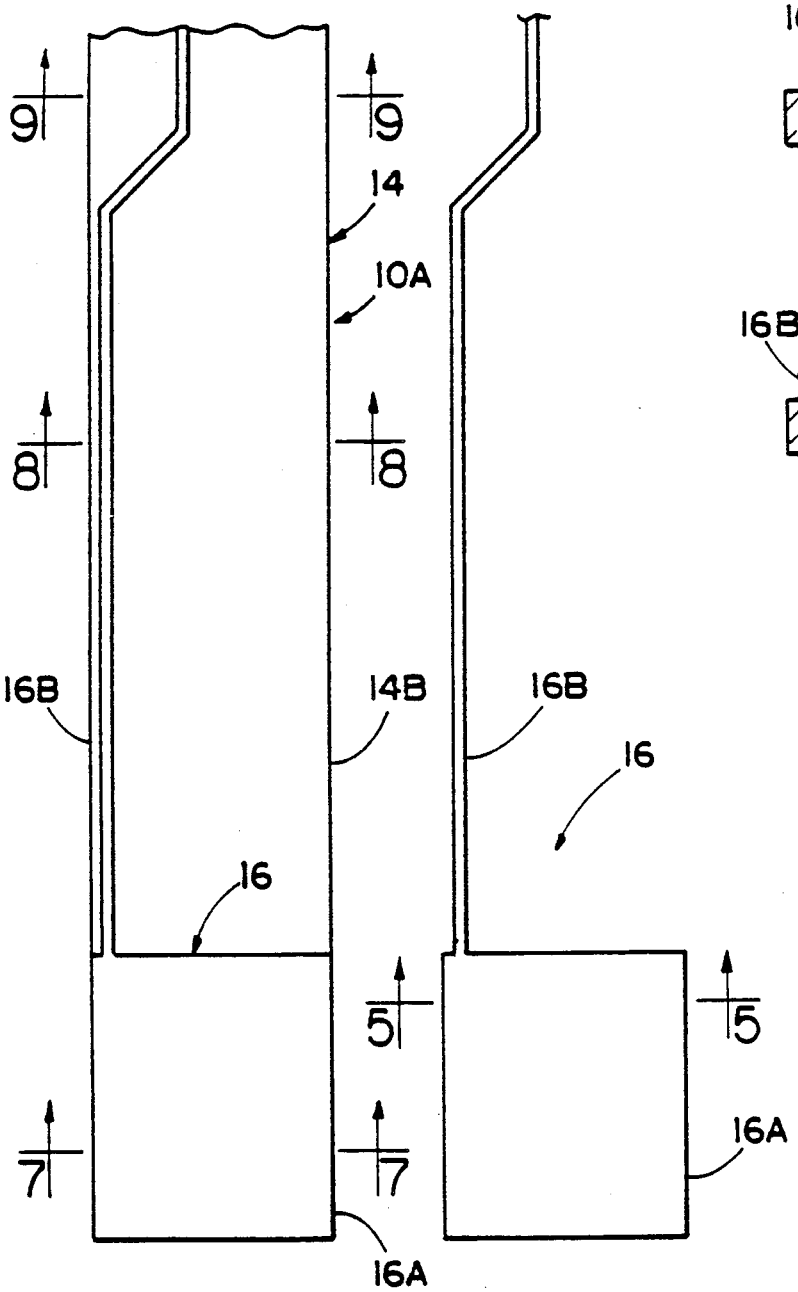
FIG. 6
FIG. 4
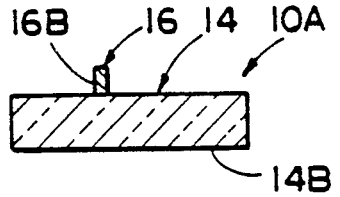
FIG. 9
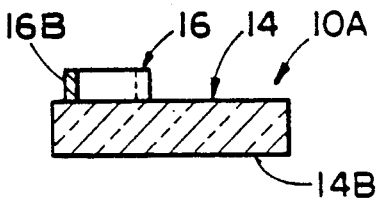
FIG. 8
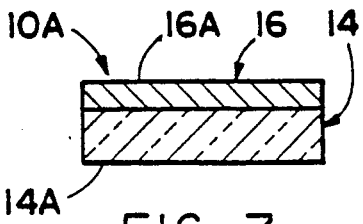
FIG. 7
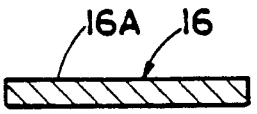
FIG. 5

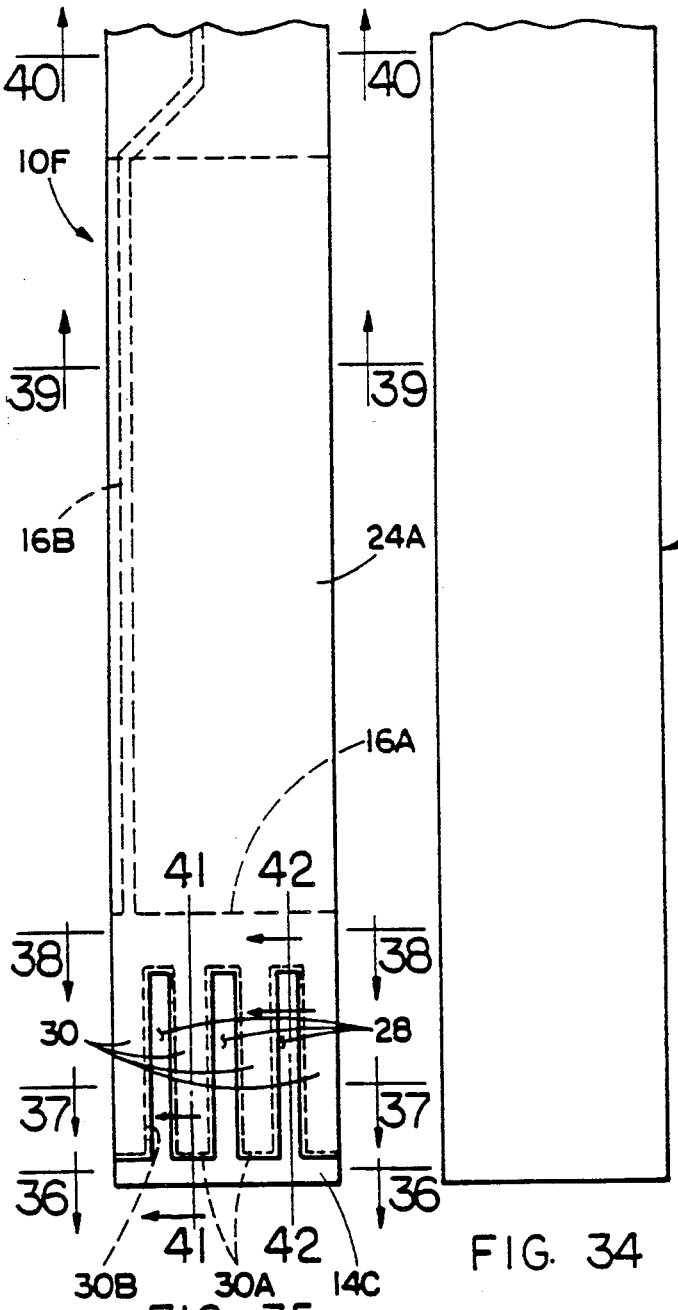
FIG. 35
FIG. 34
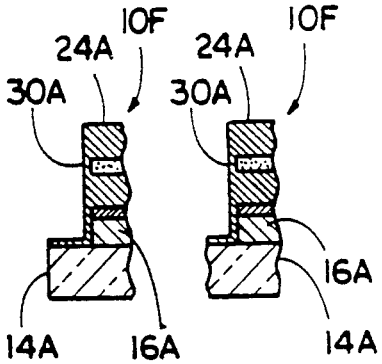
FIG. 41
FIG. 42
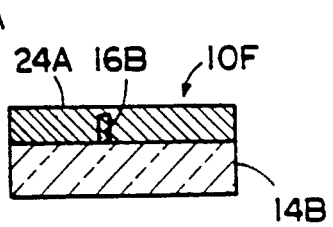
FIG. 40
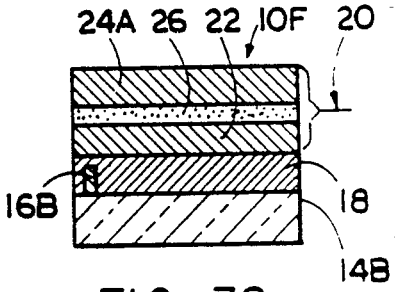
FIG. 39
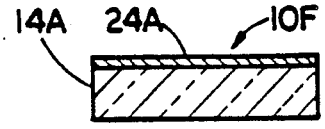
FIG. 36
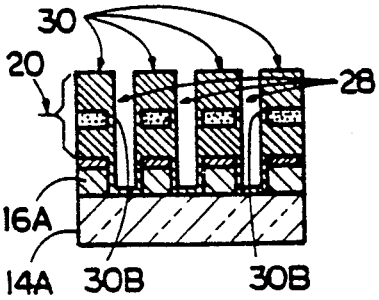
FIG. 37
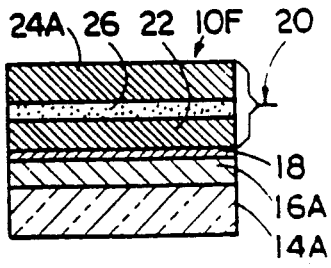
FIG. 38

MULTI-LAYER STRUCTURE AND METHOD OF CONSTRUCTING THE SAME FOR PROVIDING TFEL EDGE EMITTER MODULES

CROSS REFERENCE TO RELATED APPLICATIONS

Reference is hereby made to the following copending U. S. applications dealing with related subject matter and assigned to the assignee of the present invention:

1. "A Thin Film Electroluminescent Edge Emitter Structure On A Silicon Substrate" by Z. K. Kun et al, assigned U.S. Ser. No. 273,296 and filed Nov. 18, 1988, a continuation-in-part of U.S. Ser. No. 235,143, filed Aug. 23, 1988. (W.E. 53,477I)

2. "Process For Defining An Array Of Pixels In A Thin Film Electroluminescent Edge Emitter Structure" by W. Kasner et al, assigned U.S. Ser. No. 254,282 and filed Oct. 6, 1988. (W.E. 54,876)

3. "A Multiplexed Thin Film Electroluminescent Edge Emitter Structure And Electronic Drive System Therefor" by D. Leksell et al, assigned U.S. Ser. No. 343,697 and filed Apr. 24, 1989. (W.E. 54,925).

4. "A Thin Film Electroluminescent Edge Emitter Assembly And Integral Packaging" by Z. K. Kun et al, assigned U.S. Ser. No. 351,495 and filed May 15, 1989. (W.E. 55,090)

5. "Thin Film Electroluminescent Edge Emitter Structure With Optical Lens And Multi-Color Light Emission Systems" by Z. K. Kun et al, assigned U.S. Ser. No. 353,316 and filed May 17, 1989, a continuation-in-part of U.S. Ser. No. 280,909, filed Dec. 7, 1988, which is a continuation-in-part of U.S. Ser. No. 248,868, filed Sep. 23, 1988. (W.E. 53,478I and 55,192)

6. "Integrated TFEL Flat Panel Face And Edge Emitter Structure Producing Multiple Light Sources" by Z. K. Kun et al, assigned U.S. Ser. No. 377,690 and filed Jul. 10, 1989. (W.E. 55,313)

7. "TFEL Edge Emitter Module and Packaging Assembly Employing Sealed Cavity Capacity Varying Mechanism" by N. J. Phillips et al, assigned U.S. Ser. No. 434,392 and filed Nov. 13, 1989. (W.E. 55,578)

BACKGROUND OF THE INVENTION

1. Field of the Invention

The present invention relates generally to a thin film electroluminescent (TFEL) edge emitter structure, and more particularly, to a multi-layer structure and method of constructing the same for providing TFEL edge emitter modules.

2. Description of the Prior Art

Electroluminescence is a phenomena which occurs in certain materials from the passage of an electric current through the material. The electric current excites the electrons of the dopant in the light emitting material to higher energy levels. Emission of radiation thereafter occurs as the electrons emit or give up the excitation energy and fall back to lower energy levels. Such electrons can only have certain discrete energies. Therefore, the excitation energy is emitted or radiated at specific wavelengths depending on the particular material.

TFEL devices that employ the electroluminescence phenomena have been devised in the prior art. It is well known to utilize a TFEL device to provide an electronically controlled, high resolution light source. One arrangement which utilizes the TFEL device to provide the light source is a flat panel display system, such as disclosed in Asars et al U.S. Pat. No. 4,110,664 and Luo et al U.S. Pat. No. 4,006,383, assigned to the assignee of the present invention. In a TFEL flat panel display system, light emissions are produced substantially normal to a face of the device and so provide the light source at the device face. Another arrangement utilizing the TFEL device to provide the light source is a line array, or edge, emitter, such as disclosed in a Kun et al U.S. Pat. No. 4,535,341, also assigned to the assignee of the present invention. In a TFEL edge emitter system, light emissions are produced substantially normal to an edge of the TFEL device and so provide the light source at the device edge. Edge emissions by the TFEL edge emitter system are typically 30 to 40 times brighter than the face emissions by the TFEL flat panel display system under approximately the same excitation conditions.

From the above discussion, it can be appreciated that the TFEL edge emitter structure of the Kun et al patent potentially provides a high resolution light source promising orders of magnitude of improved performance over the TFEL flat panel face emitter structure in terms of light emission brightness. However, there is a need for improvements in the overall structure and technique of constructing TFEL edge emitter modules to enhance performance overall.

SUMMARY OF THE INVENTION

The present invention relates to a TFEL multi-layer structure encompassing several combinations of constructional features designed to satisfy the aforementioned needs. The present invention also relates to a method of constructing the TFEL multi-layer structure for providing TFEL edge emitter modules.

All combinations of constructional features of the TFEL multi-layer structure of the present invention include a bottom substrate layer, a lower electrode layer, a middle EL stack, and an upper electrode layer. The EL stack overlies the bottom substrate layer. The lower electrode layer is interposed between the bottom substrate layer and the EL stack.

In one combination of constructional features of the TFEL multi-layer structure, forward portions of the EL stack and lower electrode layer have formed therethrough, to the depth of the bottom substrate layer, a series of longitudinal channels and a transverse street connecting the channels and extending along a forward edge of the bottom substrate layer so as to define a plurality of transversely spaced longitudinal elements. The upper electrode layer has a forward portion composed of a plurality of transversely spaced longitudinal electrodes which overlie the longitudinal elements of the forward portions of the EL stack and lower electrode layer so as to define therewith a plurality of pixels having light-emitting front edges which are setback from the forward edge of the bottom substrate layer by the width of the street.

In another combination of constructional features of the TFEL multi-layer structure, the longitudinal elements of the forward portions of the EL stack and lower electrode layer are formed by alternately longitudinally spaced front-facing walls and transversely spaced side-facing walls interconnecting the front-facing walls. The front-facing and side-facing walls extend to the depth of the bottom substrate layer and define the plurality of transversely spaced longitudinal channels between the longitudinal elements. The EL stack includes a light-energy generating layer overlying the lower electrode layer and a dielectric layer overlying the light-energy generating layer. The dielectric layer sealably covers the light-energy generating layer, the front-facing and side-facing walls of the longitudinal elements, and portions of the bottom substrate layer exposed in the channels so as to sealably encapsulate the forward portions of the lower electrode layer and EL stack light-energy generating layer upon the bottom substrate layer.

In still another combination of constructional features of the TFEL multi-layer structure, a rearward portion of the lower electrode layer overlies the bottom substrate layer so as to occupy only a first region and not a second region thereon. The longitudinal electrodes of the upper electrode layer have rearward portions overlying only the section of the rearward portion of the EL stack which, in turn, overlies the second region on the bottom substrate layer not occupied by the rearward portion of the lower electrode layer such that electrical isolation is thus provided between the rearward portions of the lower and upper electrode layers. The first region on the bottom substrate layer is substantially narrower than the second region thereon. The second region on the bottom substrate layer is occupied by a filler layer, such as an adhesive, interposed between the bottom substrate layer and the EL stack.

In yet another combination of constructional features of the TFEL multi-layer structure, a bus bar layer composed of a series of longitudinally spaced transverse electrical conductors overlies a rearward portion of the EL stack and crosses rearward portions of longitudinal electrodes of the upper electrode layer. An insulation layer is interposed between the bus bar layer and the rearward electrode portions of the upper electrode layer. One of the bus bar layer and the upper electrode layer overlies the other with the insulation layer located therebetween.

The present invention also relates to a method of constructing the TFEL multi-layer structure for providing a TFEL edge emitter module. The constructing method basically comprises the steps of forming a lower electrode layer over a bottom substrate layer, forming an electroluminescent (EL) stack over the lower electrode layer, and forming an upper electrode layer over the EL stack. Prior to forming the upper electrode layer, a series of longitudinal channels and a transverse street connecting the channels and extending along a forward edge of the bottom substrate layer are formed in forward portions of the EL stack and lower electrode layer to the depth of the bottom substrate layer so as to define a plurality of transversely spaced longitudinal elements on the forward portions of the EL stack and lower electrode layer having front light-emitting edges setback from the forward edge of the bottom substrate layer by the width of the street. The upper electrode layer composed of a plurality of transversely spaced longitudinal electrodes is then formed over the EL stack with a forward portion of the longitudinal electrodes overlying the longitudinal elements on the forward portions of the EL stack and lower electrode layer.

Further, prior to forming the upper electrode layer on the EL stack, a dielectric layer of the EL stack overlying a light-energy generating layer thereof is removed and then formed a second time over the light-energy generating layer. However, now the newly-formed dielectric layer of the EL stack sealably covers the light-energy generating layer, front-facing and side-facing walls of the longitudinal elements which define the channels therebetween, and portions of the bottom substrate layer exposed in the channels so as to thereby sealably encapsulate the forward portions of the EL stack light-energy generating layer and the lower electrode layer upon the bottom substrate layer.

Still further, the lower electrode layer is formed over the bottom substrate layer such that a rearward portion of the lower electrode layer occupies a first region but not a second region on the bottom substrate layer. The upper electrode layer is subsequently formed over the EL stack such that a rearward portion of the upper electrode layer overlies only the section of the EL stack that, in turn, overlies the second region on the bottom substrate layer not occupied by the rearward portion of the lower electrode layer. Electrical isolation is thus provided between the rearward portions of the lower and upper electrode layers.

Still further, a bus bar layer and insulation layer are formed over the EL stack. In one embodiment, the bus bar layer is formed over an upper electrode layer with the insulation layer located therebetween. In an alternative embodiment, the upper electrode layer is formed over the bus bar layer with the insulation layer located therebetween. In both embodiments, selected portions of the upper electrode layer and bus bar layer make electrical connections together through the insulation layer.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which:

FIG. 4 is a fragmentary plan view of a lower common electrode layer of the TFEL structure.

FIG. 5 is a cross-sectional view of the lower common electrode layer taken along line 5—5 in FIG. 4.

FIG. 6 is a fragmentary plan view of a partially constructed TFEL structure illustrating the lower electrode layer of FIG. 4 applied over the bottom substrate layer of FIG. 2.

FIGS. 7-9 are different cross-sectional views of the partially constructed TFEL structure of FIG. 6 taken respectively along lines 7—7 to 9—9 in FIG. 6.

FIG. 34 is a fragmentary plan view of an upper dielectric layer of the EL stack.

FIG. 35 is a fragmentary plan view of a partially constructed TFEL structure similar to that of FIG. 22 but after the upper dielectric layer of FIG. 34 has been applied on the partially constructed TFEL structure of FIG. 28 completing construction of the EL stack and sealably covering the side and front edges of the partially-constructed pixels and the surfaces of the street and channels defined on the bottom substrate layer of the structure.

FIGS. 36-40 are different cross-sectional views of the partially constructed TFEL structure of FIG. 35 taken respectively along lines 36—36 to 40—40 in FIG. 35.

FIGS. 41 and 42 are different fragmentary cross-sectional view of the pixels and channels of the partially constructed TFEL structure of FIG. 35 taken respectively along lines 41—41 and 42—42 in FIG. 35.

DESCRIPTION OF THE PREFERRED EMBODIMENTS

In General

Figure 1B:
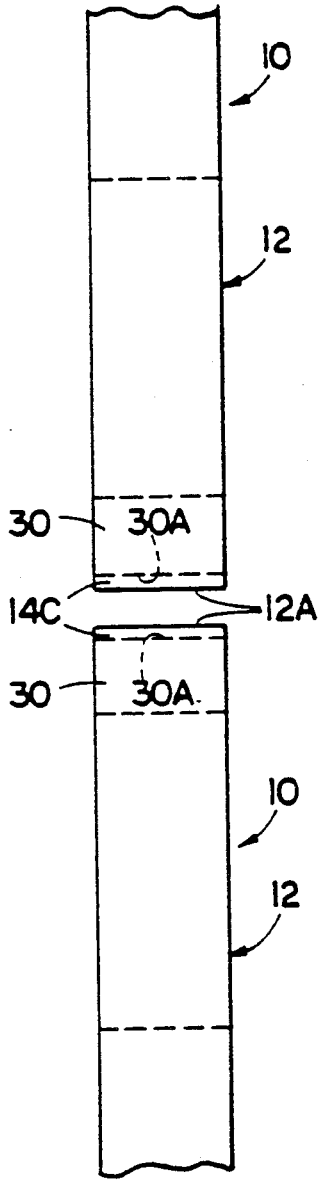
FIGS. 1A and 1B plan views of a TFEL multi-layer structure in accordance with the present invention respectively before and after separation into individual TF emitter modules.
Figure 1A:
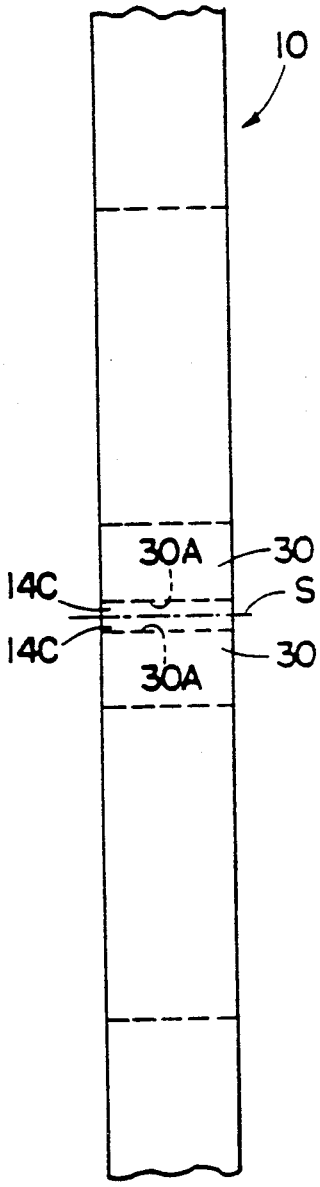

Referring to the drawings, and particularly to FIGS. 1A and 1B, there is illustrated in diagrammatic form a TFEL multi-layer or laminated structure of the present invention, generally designated 10, for providing multiple TFEL edge emitter modules 12. Each module 12 provided by construction of the structure 10 is a solid state, electronically controlled, high resolution light source.

Figure 2:
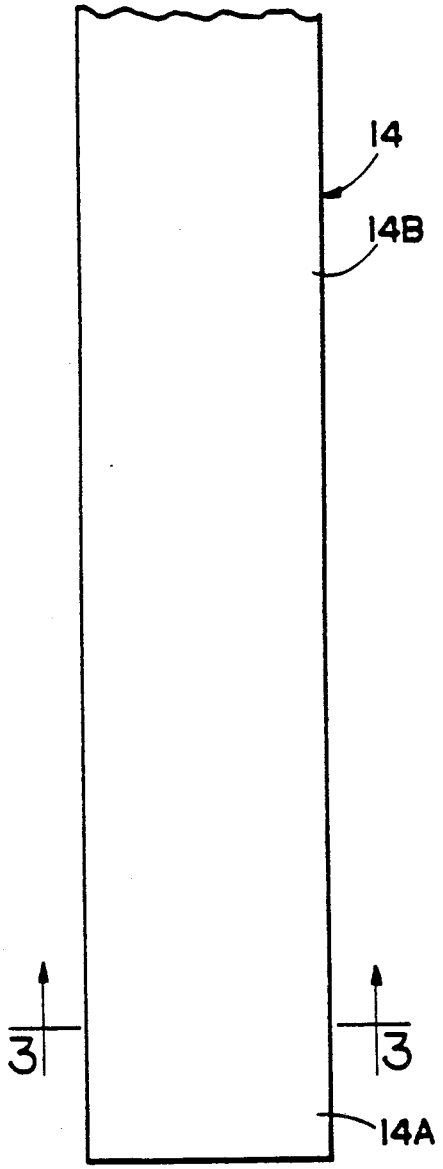
FIG. 2 is a fragmentary plan view of a bottom substrate layer of the TFEL structure for providing one TFEL edge emitter module.
Figure 78:
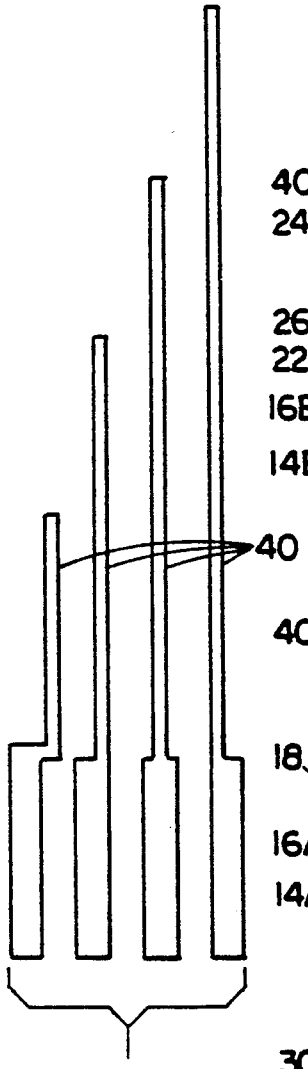
FIG. 78 is a fragmentary plan view of another upper electrode layer composed of a plurality of control electrodes of the TFEL structure.
Figure 83:
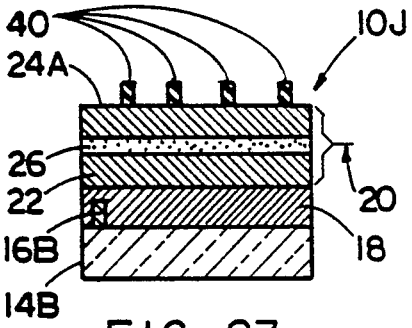
FIGS. 80-83 are different cross-sectional views of the partially constructed TFEL structure of FIG. 79 taken respectively lines 80—80 to 83—83 in FIG. 79.
Figure 82:
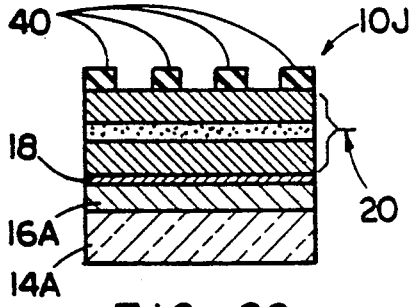
Figure 80:
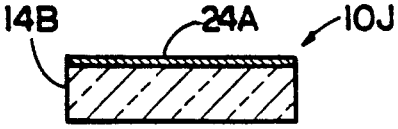
Figure 81:
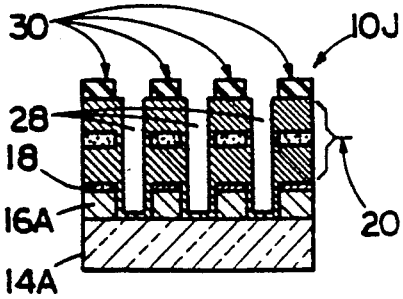
Figure 86:
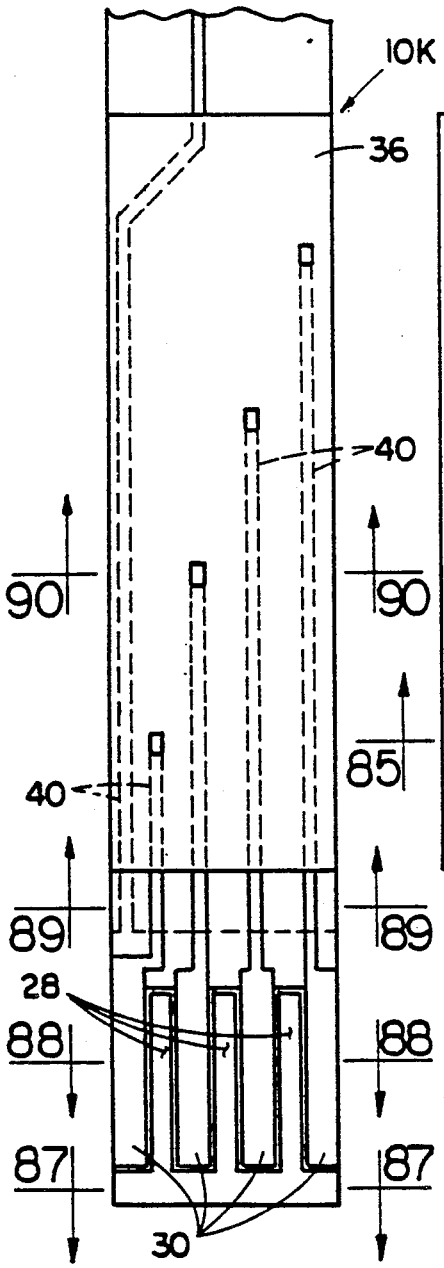
FIG. 86 is a fragmentary plan view of a partially completed TFEL structure illustrating the insulation layer of FIG. 84 applied over the plurality of control electrodes at the crossover section of the partially completed TFEL structure of FIG. 79.

In FIGS. 1A and 1B, the TFEL multi-layer structure 10 is shown respectively before and after separation into individual TFEL edge emitter modules 12. The structure 10 contains a large number of the modules 12, although only two are illustrated. As seen in FIG. 1A, before separation of the structure 10, the modules 12 are integrally connected together at what will become front edges 12A thereof, as seen in FIG. 1B, once the modules are separated from one another, such as by severing along line S in FIG. 1A. The modules 12 shown in FIG. 1A are also integrally connected to other modules not shown at what will become rear edges thereof. For purposes of clarity, FIGS. 2-78 illustrate the step-by-step construction of the structure 10 for providing one of the modules 12. However, it should be understood that in actuality a plurality of the modules 12 would be provided simultaneously in the construction of the structure 10.

Figure 3:
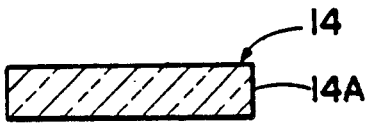
FIG. 3 is a cross-sectional view of the bottom substrate layer taken along line 3—3 in FIG. 2.

Referring now to FIGS. 2 and 3, there is seen a bottom substrate layer 14 for use in one module 12 of the TFEL structure 10. Preferably, the substrate layer 14 is a glass material. To prepare the glass substrate layer 14 for use in constructing the structure 10, it is first cleaned, such as by a conventional plasma cleaning technique, and then shrunk in size, such as by baking it at an elevated temperature, for example about 620°C., for several hours.

Referring to FIGS. 4 and 5, there is shown a lower common electrode layer 16 for use in one module 12 of the TFEL structure 10. To form the lower electrode layer 16, a suitable metal layer, such as composed of chrome palladium, is first deposited over the bottom substrate layer 14 so as to entirely cover the substrate layer. Deposition can be by a conventional vacuum system employing a known E-beam evaporated metal deposition technique. Alternatively, a known thermal source or sputtering technique can be utilized. Next, a suitable photoresist material is applied over the entire metal layer. Then, a mask in the pattern of the desired lower electrode layer 16 is placed over the metal layer, and the photoresist material remaining uncovered by the mask is exposed to light. Thereafter, the exposed photoresist material is cured. The cured photoresist is removed by immersion in a developing solution which exposes the underlying material. Then, the underlying metal is removed by application of a suitable etchant. The photoresist material previously covered by the mask is now stripped off or removed. A metal layer is now uncovered having the desired final pattern which provides the lower electrode layer 16 which overlies the bottom substrate layer 14. The technique just described is a conventional wet etching process. Alternatively, a conventional dry etching process can be used.

FIGS. 6-9 illustrate a partially constructed TFEL structure 10A having the lower electrode layer 16 of FIG. 4 applied in the desired pattern over the bottom substrate layer 14 of FIG. 2. It will be noted in FIGS. 4 and 6 that a forward portion 16A of the lower electrode layer 16 is coextensive in length and width with a forward portion 14A of the bottom substrate layer 14 which it covers. On the other hand, a rearward portion 16B of the lower electrode layer 16 is connected to the forward portion 16A thereof and extends the length of a rearward portion 14B of the substrate layer 14. However, the rearward portion 16B of the lower electrode layer 16 is substantially reduced in width compared to the width of the rearward portion 14B of the bottom substrate layer 14.

Figure 10:
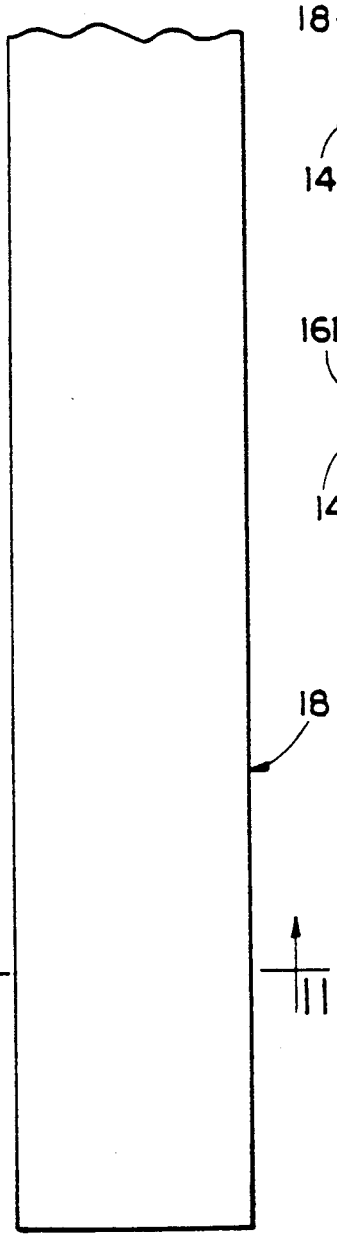
FIG. 10 is a fragmentary plan view of an adhesive layer of the TFEL structure.
Figure 15:
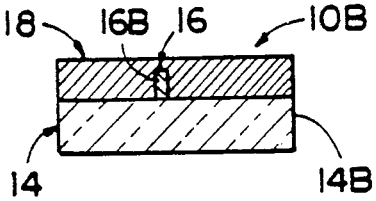
FIGS. 13-15 different cross-sectional views of the partially constructed TFEL structure of FIG. 12 taken respectively along lines 13—13 to 15—15 in FIG. 12.
Figure 14:
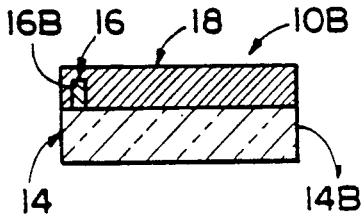
Figure 13:
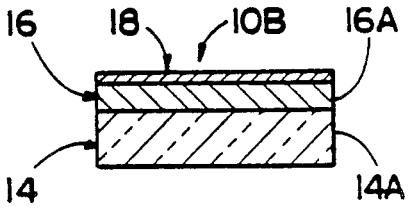
Figure 11:
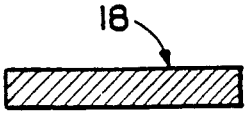
FIG. 11 is a cross-sectional view of the adhesive layer taken along line 11—11 in FIG. 10.

Referring to FIG. 10 and 11, there is illustrated an adhesive layer 18, such as silicon dioxide, used next in constructing the one module 12 of the TFEL structure 10. To prepare the partially constructed TFEL structure 10 for attachment of the electroluminescent (EL) stack 20 of FIG. 16 to the lower electrode layer 18 and bottom substrate layer 14, the adhesive layer 18 is first deposited over the partially constructed TFEL structure 10A of FIG. 6 so as to entirely cover the same. FIGS. 12-15 illustrate a partially constructed TFEL structure 10B having the adhesive layer 18 of FIG. 10 applied over the lower electrode layer 16 and bottom substrate layer 14 of FIG. 6.

Figure 16:
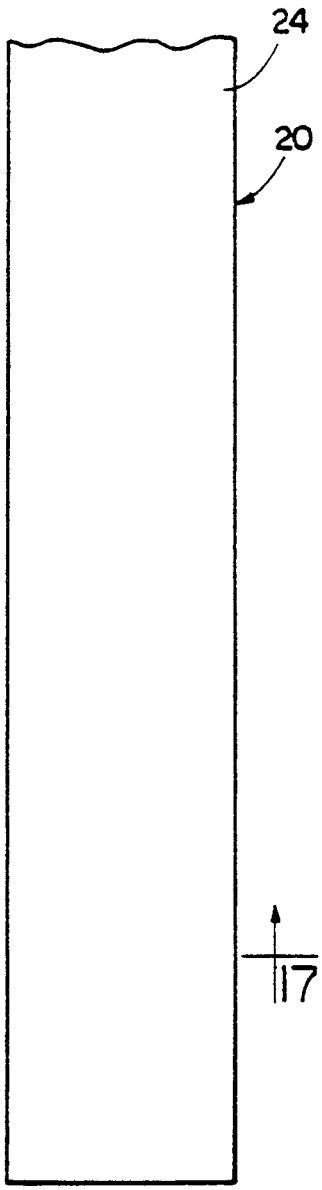
FIG. 16 is a fragmentary plan view of an EL light-emitting stack of the TFEL structure.
Figure 21:
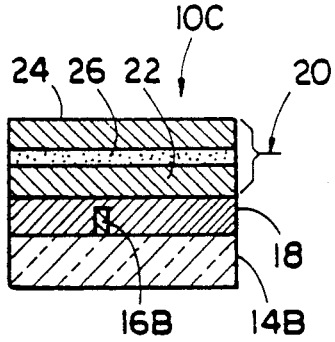
FIGS. 19-21 are different cross-sectional views of the partially constructed TFEL structure of FIG. 18 taken respectively along lines 19—19 to 21—21 in FIG. 18.
Figure 20:
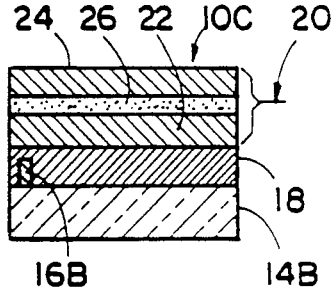
Figure 19:
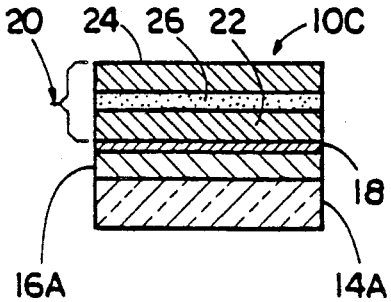
Figure 17:
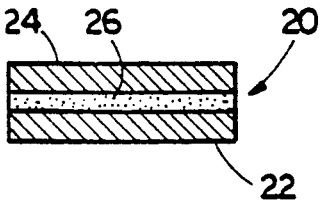
FIG. 17 is a cross-sectional view of the EL stack taken along line 17—17 in FIG. 16.

Referring to FIGS. 16 and 17, there is shown the EL light-energy generating stack 20 used in the one module 12 of the TFEL structure. The EL stack 20 includes a lower dielectric layer 22, an upper dielectric layer 24, and a middle light-energy generating layer 26. The layers 22-26 are formed on the partially constructed TFEL structure 10B of FIG. 12 in three successive stages using a conventional vacuum deposition technique. As seen in FIGS. 19-21, first, the lower dielectric layer 22, preferably composed of silicon oxide nitride (or yttrium oxide, or tantalum pentoxide, or silicon nitride, or silicon dioxide or equivalent material), is deposited on the adhesive layer 18, overlying the lower common electrode layer 16 and bottom substrate layer 14. Next, the light-energy generating layer 26, preferably composed of a phosphor material such as zinc sulfide doped with manganese, is deposited over the lower dielectric layer 22. Then, the upper dielectric layer 24, composed of the same material as the lower dielectric layer 22, is deposited over the light-energy generating layer 26. Annealing of the EL stack 20 is also performed to provide more uniform distribution of the manganese dopant within the zinc sulfide lattice structure.

It should be understood that although the EL stack 20 illustrated in FIG. 17 includes lower and upper dielectric layers 22 and 24, either dielectric layers 22, 24 may be eliminated from the EL stack 20 if desired. If the lower dielectric layer 22 and adhesive layer are not included in the EL stack 20, then it is apparent that the phosphor layer 26 will be interposed between the lower common electrode and bottom substrate layers 16 and the upper dielectric layer 24.

Figure 12:
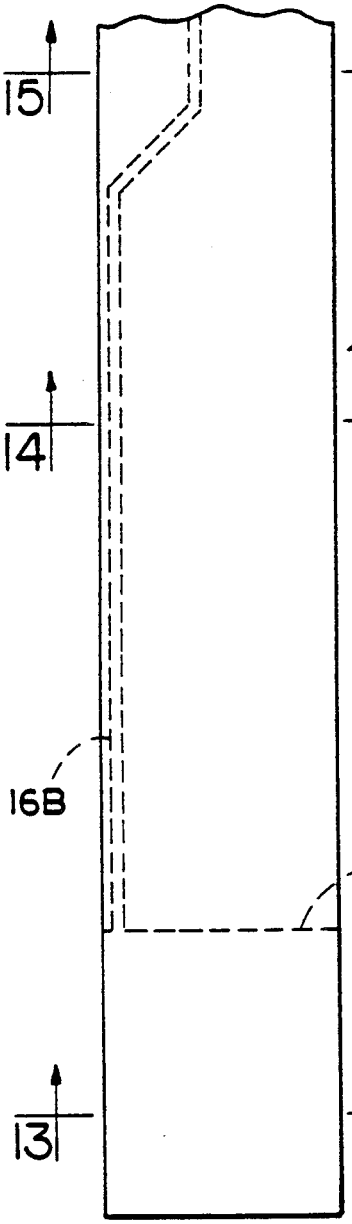
FIG. 12 is a fragmentary plan view of a partially constructed TFEL structure illustrating the adhesive layer of FIG. 10 applied over the lower electrode layer and bottom substrate layer of FIG. 6.

FIGS. 18-21 thus illustrate a partially constructed TFEL structure 10C incorporating the EL stack 20 of FIG. 16 applied directly on the adhesive layer 18 of the partially constructed structure 10B of FIG. 12. Referring now to FIGS. 22-27, there is illustrated a partially constructed TFEL structure 10D similar to the partially constructed structure 10C of FIGS. 18-21 but after a series of longitudinal channels 28 and a transverse street 14C connecting the channels 28 have been constructed on the forward end of the structure 10 down to the level of the bottom substrate layer 14 so as to define a plurality of partially constructed edge emitter pixels 30. The channel 28 serves to optically isolate adjacent pixels 30 from one another to prevent optical cross-talk. The pixels 30 have inner and outer front-facing walls 30A and opposite side-facing walls 30B which bound the generally rectangular-shaped channels 28 and the street 14C. The formation of the channels 28 and street 14C, in effect, define the front light-emitting edges 30A of the pixels 30.

Figure 18:
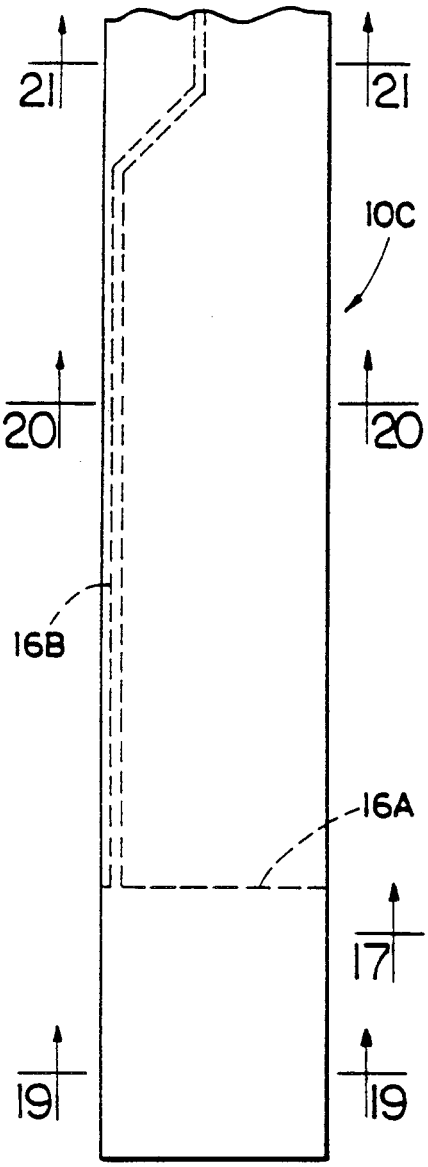
FIG. 18 is a fragmentary plan view of a partially constructed TFEL structure illustrating the EL stack of FIG. 16 applied over the adhesive layer, lower electrode layer, and bottpm substrate layer of FIG. 12.

The partially constructed edge emitter pixels 30 are formed by use of a photoresist material and a pixel definition mask which covers the entire partially constructed TFEL structure 10C of FIG. 18. The same basic steps of exposing the mask to light, curing the photoresist and etching away the materials not covered by the mask as described earlier are used here to form the channels 28 and the street 14C and so need not be described in detail again. Only four pixels 30 are shown for purposes of brevity and clarity; however, it should be understood that more than four pixels are typically provided on a single TFEL edge emitter module 12. It will also be noted that an original portion of the EL stack 20 has now been removed on the rearward portion 14B of the bottom substrate layer 14 at a location spaced from the forward portion 14A thereof and immediately after the location of a dogleg 16C in the rearward portion 16B of the lower electrode layer 16.

As can be understood from FIG. 1A, the streets 14C on the bottom substrate layer 14 is where two TFEL edge emitter modules 12 are integrally connected together. The substrate layer 14 of the structure 10 will be severed along line S to provide the two separate modules 12. By setting back the forward light-emitting edges, or forward-facing walls 30A, of the pixels 30 from the line of separation S by the width of the street 14C, the severing of the two modules 12 which may produce an irregular front edge 14A on the substrate layer 14 will not affect the quality of the front light-emitting edges 30A of the pixels 30.

Figure 22:
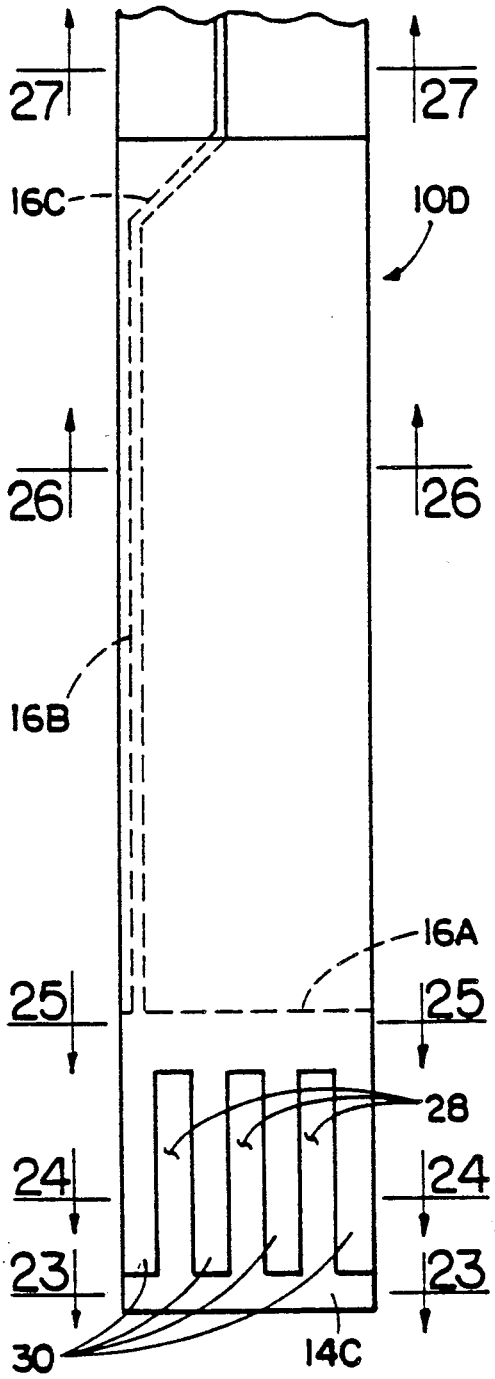
FIG. 22 is a fragmentary plan view of a partially constructed TFEL structure similar to that of FIG. 18 but after a series of longitudinal channels and a transverse street connecting the channels have been constructed on the structure down to the level of the bottom substrate layer thereof to define a plurality of partially constructed edge emitter pixels.
Figure 23:
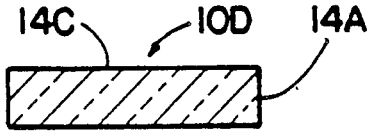
FIGS. 23-27 are different cross-sectional views of the partially constructed TFEL structure of FIG. 22 taken respectively along lines 23—23 to 27—27 in FIG. 22.
Figure 27:
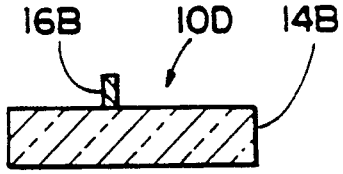
Figure 26:
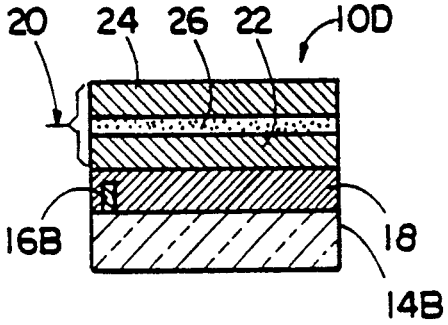
Figure 25:
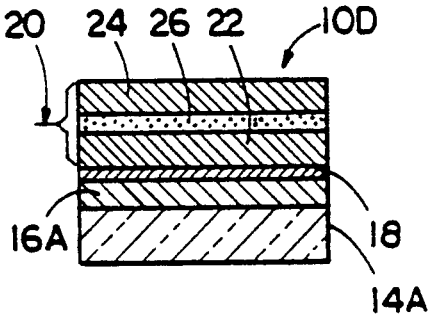
Figure 24:
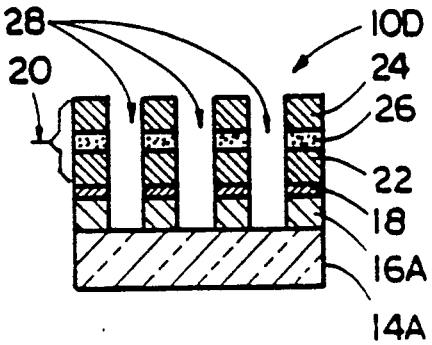
Figure 28:
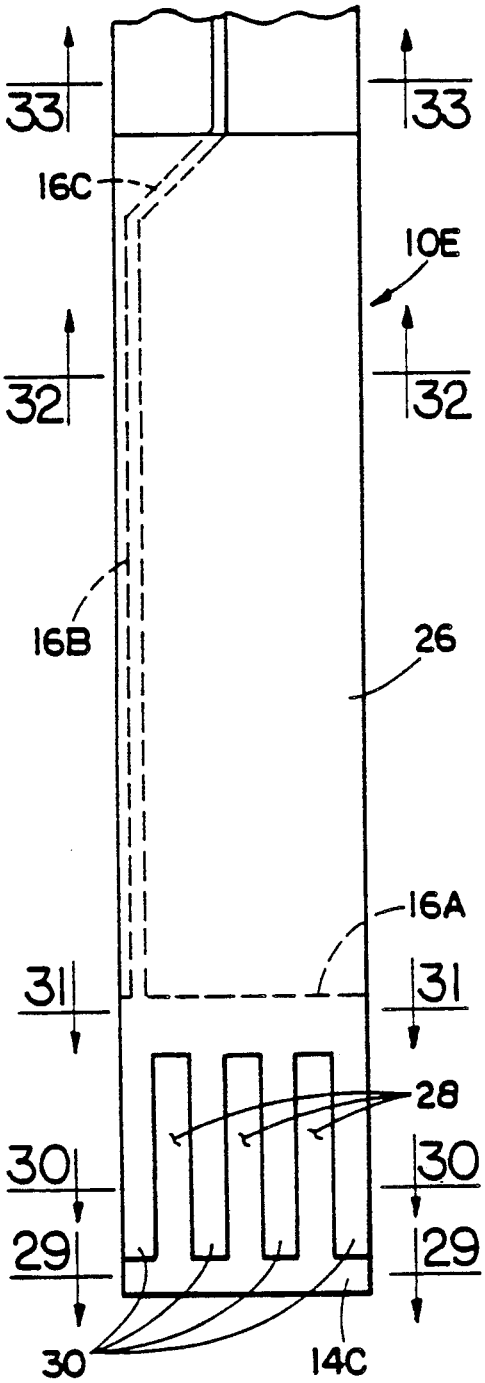
FIG. 28 is a fragmentary plan view of a partially constructed TFEL structure similar to that of FIG. 22 but after an upper dielectric layer of the EL stack has been removed.
Figure 29:
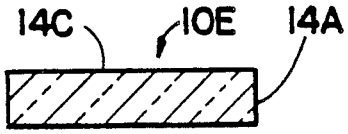
FIGS. 29-33 are different cross-sectional views of the partially constructed TFEL structure of FIG. 28 taken respectively along lines 29—29 to 33—33 in FIG. 28.
Figure 33:
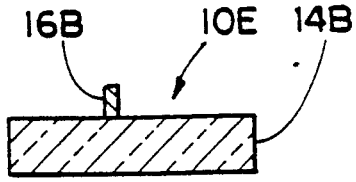
Figure 32:
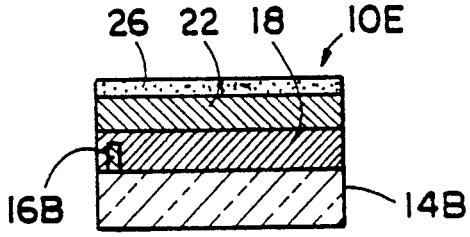
Figure 31:
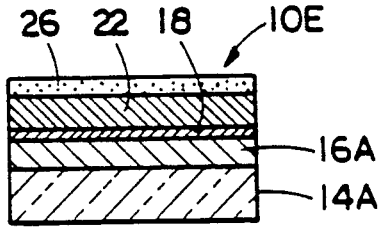
Figure 30:
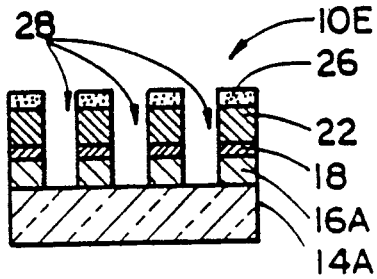
Figure 45:
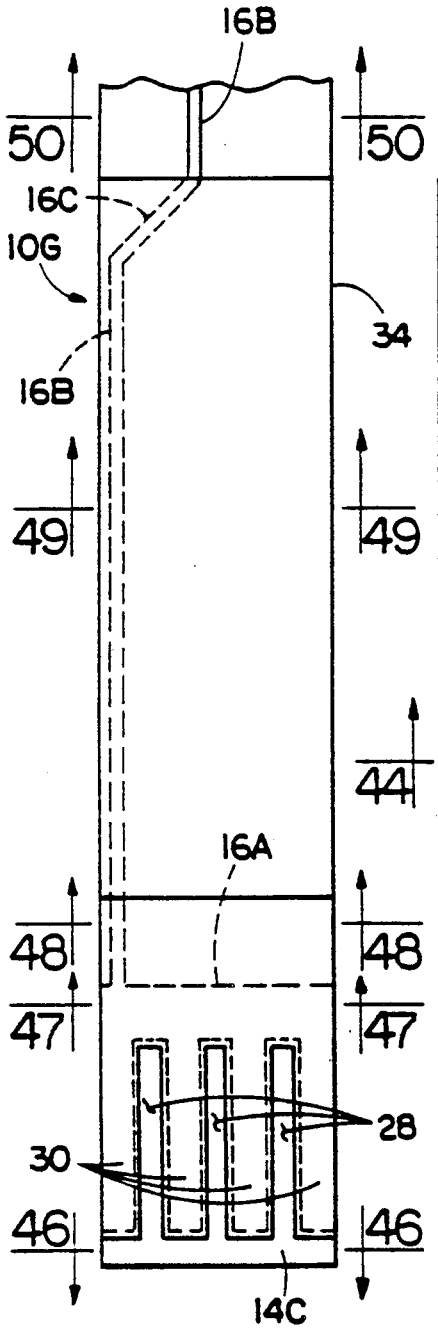
FIG. 45 is a fragmentary plan view of a partially constructed TFEL structure illustrating the lower insulation layer of FIG. 43 applied over a crossover section of the partially constructed TFEL structure of FIG. 35.

After the channels 28 and street 14C are formed, the original upper dielectric layer 24 is removed from the partially constructed TFEL structure 10D of FIG. 22 to provide the partially constructed TFEL structure of 10E of FIGS. 28-33. Removal of the original upper dielectric layer 24, by a reactive ion etch process done in a vacuum chamber, exposes the phosphor layer 26. Then, a new dielectric layer 24A is deposited back on the phosphor layer 26 by the conventional vacuum deposition technique.

Referring to FIG. 34, there is seen the new upper dielectric layer 24A of the EL stack 20. FIGS. 35-42 illustrate a partially constructed TFEL structure 10F similar to that of FIG. 22 but after the upper dielectric layer 24A of FIG. 34 has been applied on the partially constructed TFEL structure 10E of FIG. 28. Application of the upper dielectric layer 24A, such as by the conventional vacuum deposition technique, now completes construction of the EL stack 20 and sealably covers the street 14C and the front-facing and side-facing walls 30A, 30B of the partially-constructed pixels so as to sealably encapsulate the EL stack 20 and lower electrode layer 16 on the bottom substrate layer 14.

Figure 43:
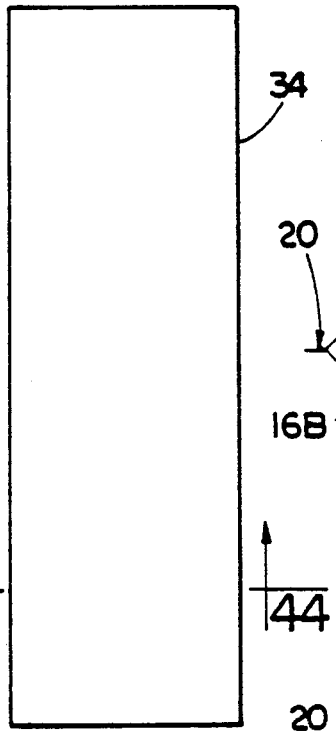
FIG. 43 is a fragmentary plan view of a lower insulation layer of the TFEL strcuture
Figure 44:
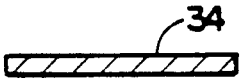
FIG. 44 is a cross-sectional view of the lower insulation layer taken along line 44—44 in FIG. 43.
Figure 50:
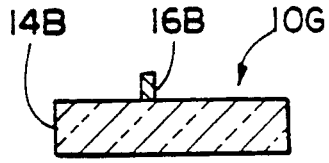
FIGS. 46-50 are different cross-sectional views of the partially constructed TFEL structure of FIG. 45 taken respectively along lines 46—46 to 50—50 in FIG. 45.
Figure 49:
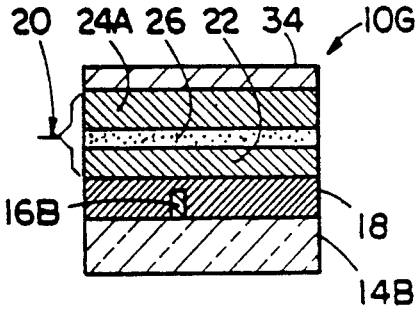
Figure 48:
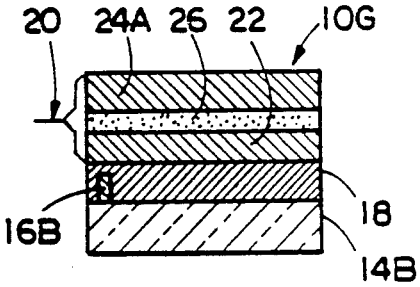
Figure 46:
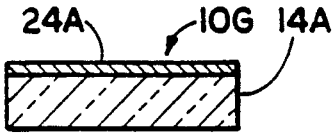
Figure 47:
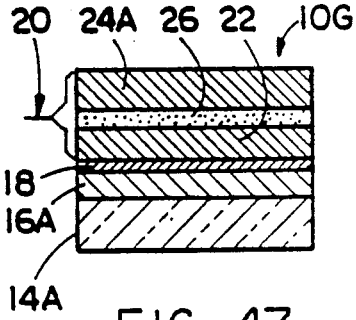
Figure 51:
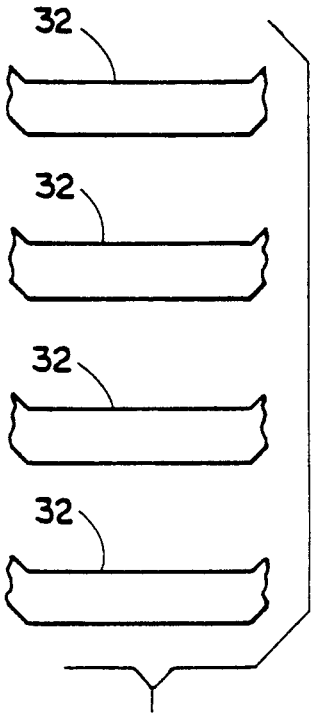
FIG. 51 is a fragmentary plan view of a bus bar layer composed of a series of longitudinally spaced electrical conductors of TFEL structure.
Figure 54:
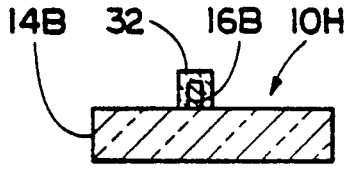
FIGS. 53-57 are different cross-sectional views of the partially constructed TFEL structure of FIG. 52 taken respectively along lines 53—53 to 57—57 in FIG. 52.
Figure 53:
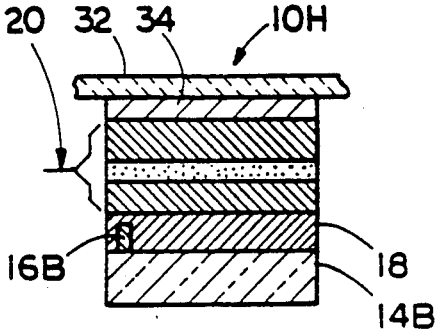
Figure 57:
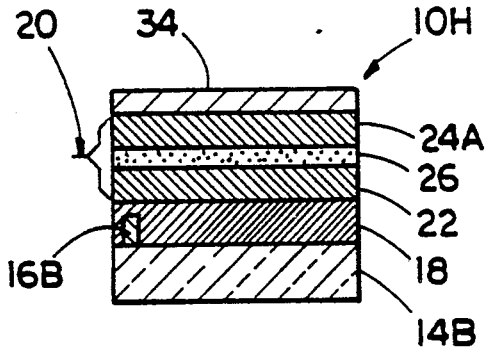
Figure 76:
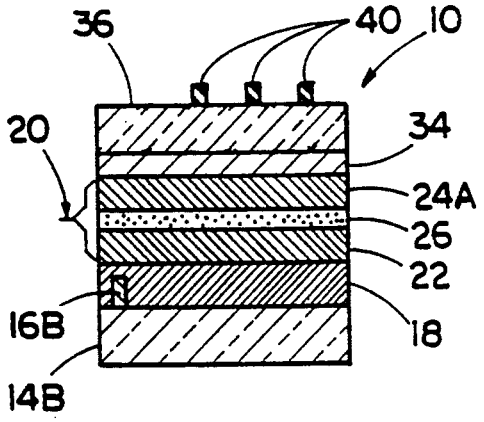
FIGS. 69-76 are different cross-sectional views of the completely constructed one embodiment of the TFEL structure of FIG. 68 taken respectively along lines 69—69 to 76—76 in FIG. 68.
Figure 56:
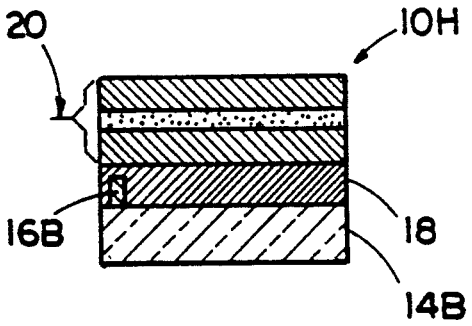

Once encapsulation of the EL stack 20 is completed, a bus bar layer composed of a series of longitudinally spaced electrical conductors 32 illustrated in FIG. 51 are applied to the partially constructed TFEL structure 10F of FIG. 35. Preferably, the bus bar conductors 32 are composed of chrome palladium gold. However, before application of the bus bar conductors 32, a lower insulation layer 34 seen in FIGS. 43 and 44 is applied on a rearward crossover region of the EL stack 20 rearwardly of a forward pixel portion thereof of the EL stack 20. The insulation layer 34 can be a polyamide material deposited by the photoresist and mask application technique as described earlier.

FIGS. 45-50 illustrate the partially constructed TFEL structure 10G after application of the lower insulation layer 34 of FIG. 43 over the crossover region of the partially constructed TFEL structure 10F of FIG. 35. FIGS. 52-57 show a partially constructed TFEL structure 10H with the series of bus bar conductors 32 of FIG. 51 deposited over the lower insulation layer 32 at the crossover region of the partially constructed TFEL structure 10G of FIG. 45. The bus bar conductors 32 are fabricated by the same general photoresist and mask application technique as described earlier.

Figure 52:
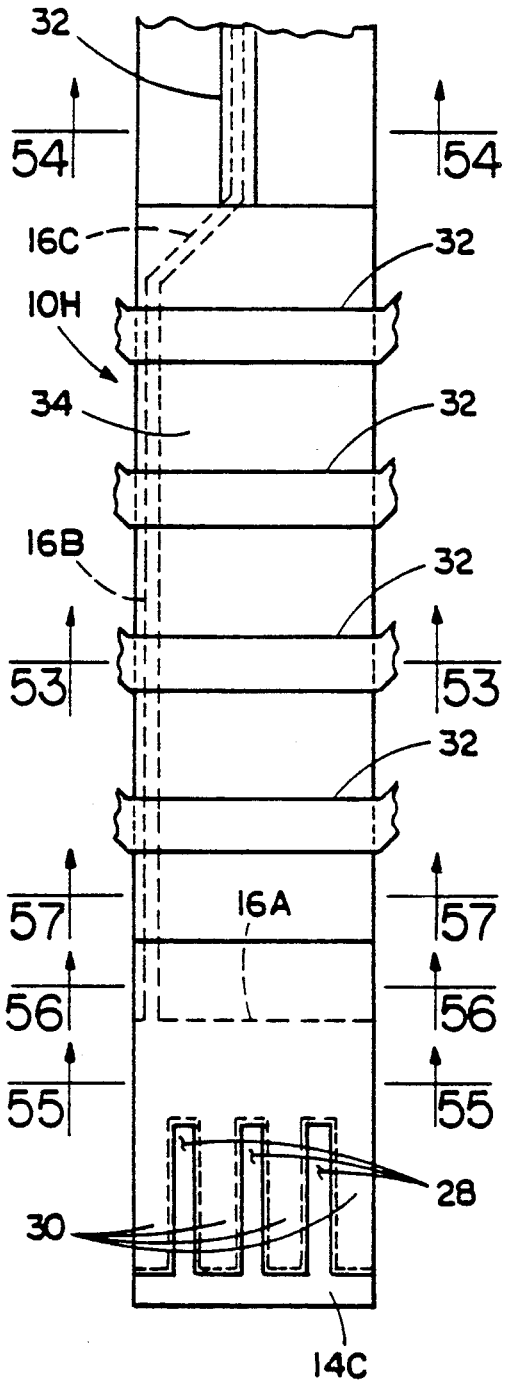
FIG. 52 is a fragmentary plan view of a partially constructed TFEL structure illustrating the series of bus bar conductors of FIG. 51 applied over the lower insulation layer at the crossover section of the partially constructed TFEL structure of FIG. 45.
Figure 58:
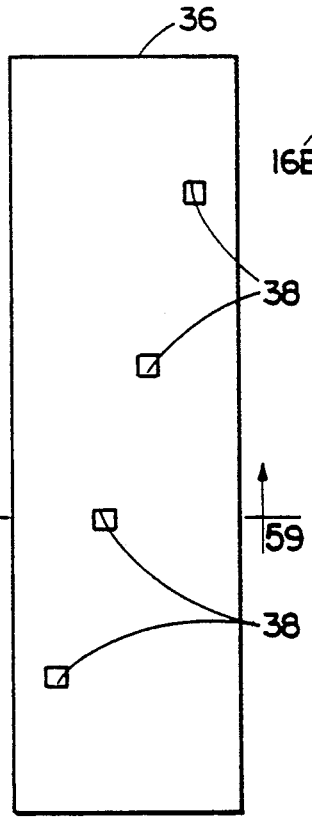
FIG. 58 is a fragmentary plan view of an upper insulation layer of the TFEL structure.
Figure 59:
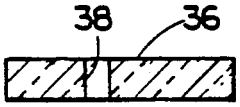
FIG. 59 is a cross-sectional view of the upper insulation layer taken along line 59—59 in FIG. 58.
Figure 65:
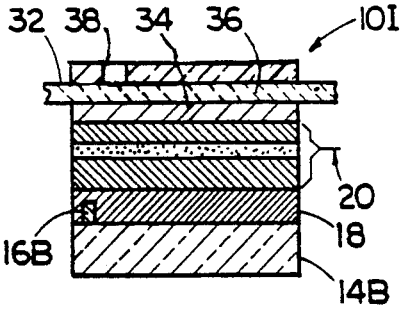
FIGS. 61-66 are different cross-sectional views of the partially constructed TFEL structure of FIG. 60 taken respectively along lines 61—61 to 65—65 in FIG. 45.
Figure 64:
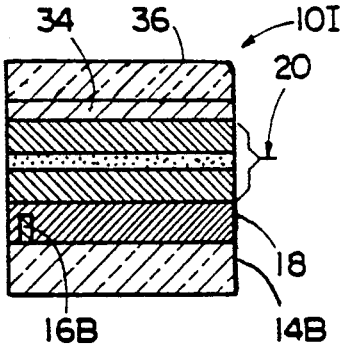
Figure 63:
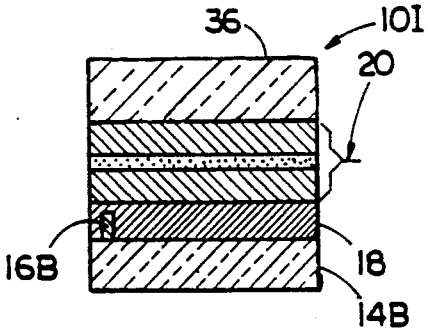
Figure 61:
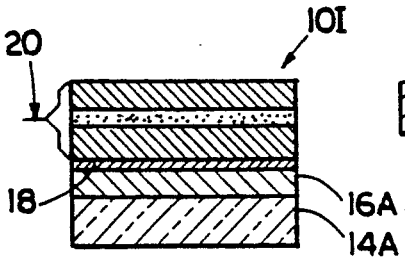
Figure 66:
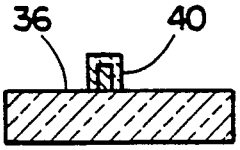
Figure 62:
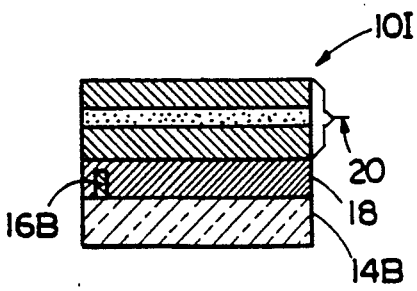
Figure 68:
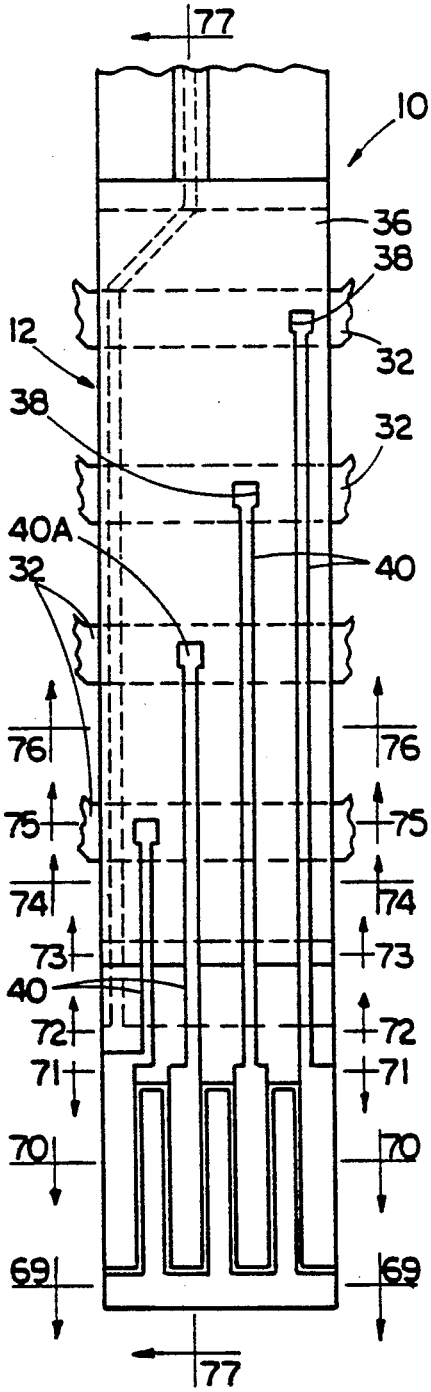
FIG. 68 is a fragmentary plan view of one embodiment of a completely constructed TFEL structure illustrating the plurality of control electrodes of FIG. 67 applied over the upper insulation layer and corresponding plurality of partially constructed pixels of the partially constructed TFEL structure of FIG. 60.

Next, an upper insulation layer 36, as seen in FIGS. 58 and 59 is applied to the partially constructed TFEL structure 10H of FIG. 52. FIGS. 60-66 show a partially constructed TFEL structure 10I with the upper insulation layer 36 of FIG. 58 deposited over the bus bar conductors 32 and the lower insulation layer 34 at the crossover region of the partially constructed TFEL structure 10H of FIG. 52. The upper insulation layer 36 is the same material as used for the lower insulation layer 34. Also, the upper insulation layer 36 is fabricated by the same general photoresist and mask application technique as described earlier. Further, a series of laterally staggered and longitudinally spaced holes 38 are formed in the upper insulation layer 36 so as to correspond with the respective pixels 30 and bus bar conductors 32. The holes 38 permit the formation of electrical connections through the upper insulation layer 36 and with the transversely extending and longitudinally spaced bus bar conductors 32 by an upper electrode layer of the TFEL structure 10.

Figure 75:
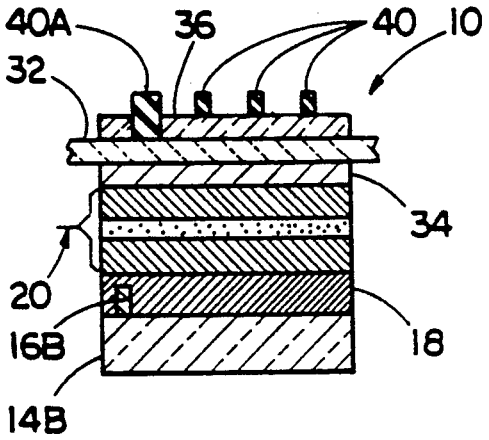
Figure 55:
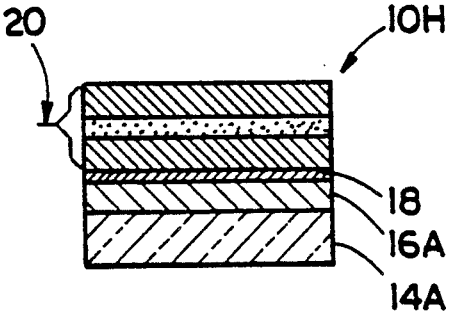
Figure 74:
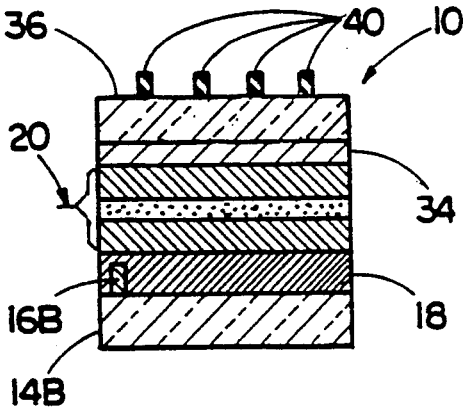
Figure 60:
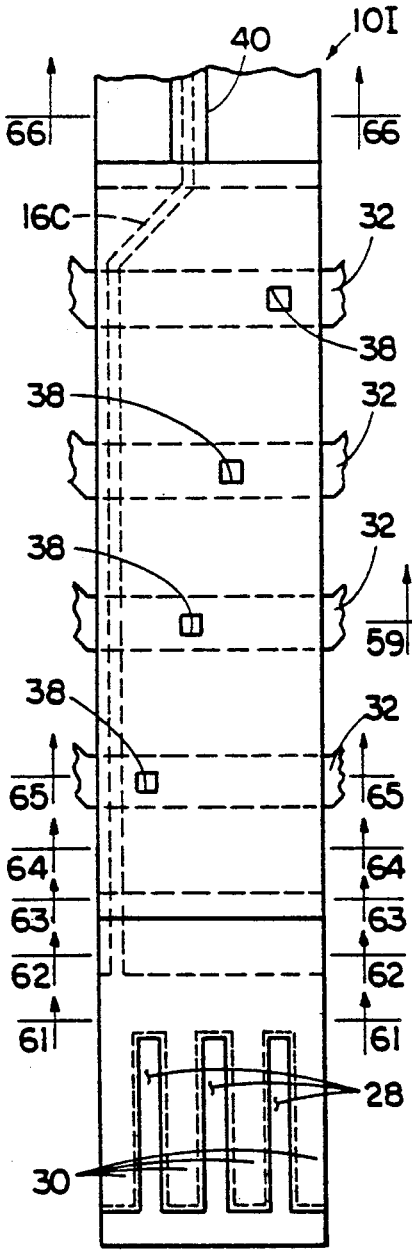
FIG. 60 is a fragmentary plan view of a partially constructed TFEL structure illustrating the upper insulation layer of FIG. 58 applied over the bus bar conductors and the lower insulation layer of the partially constructed TFEL structure of FIG. 52.
Figure 67:
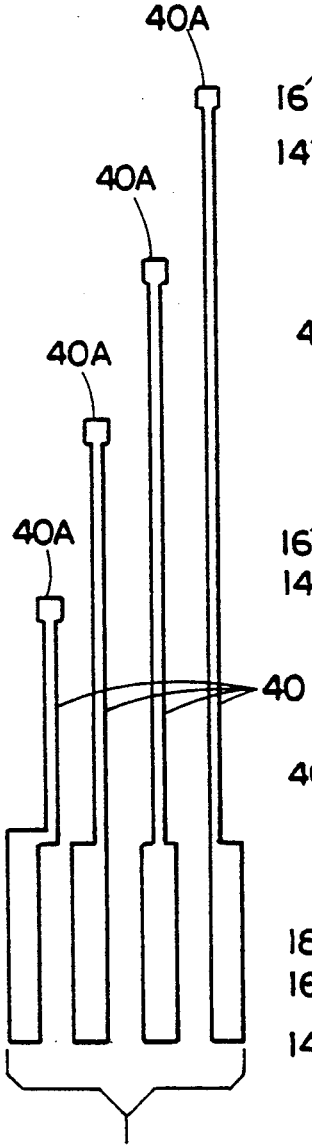
FIG. 67 is a fragmentary plan view of an upper electrode layer composed of a plurality of control electrodes of the TFEL structure.
Figure 73:
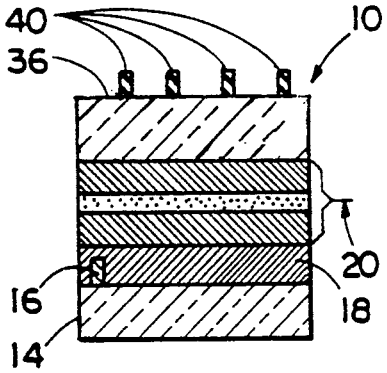
Figure 72:
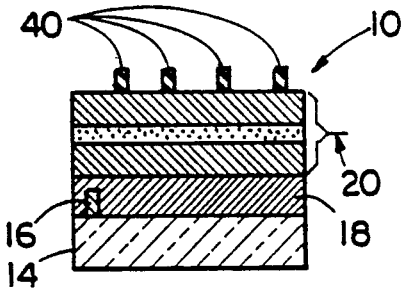
Figure 71:
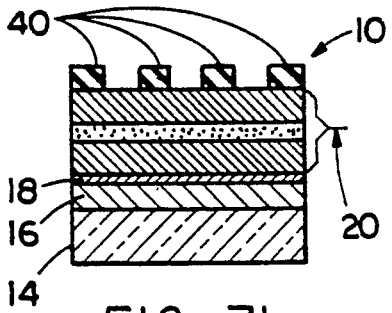
Figure 69:
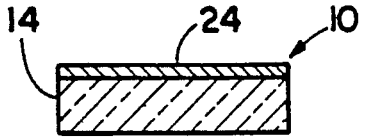
Figure 70:
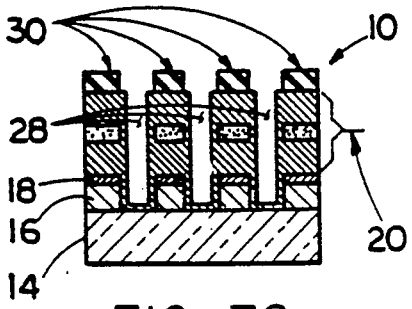
Figure 77:
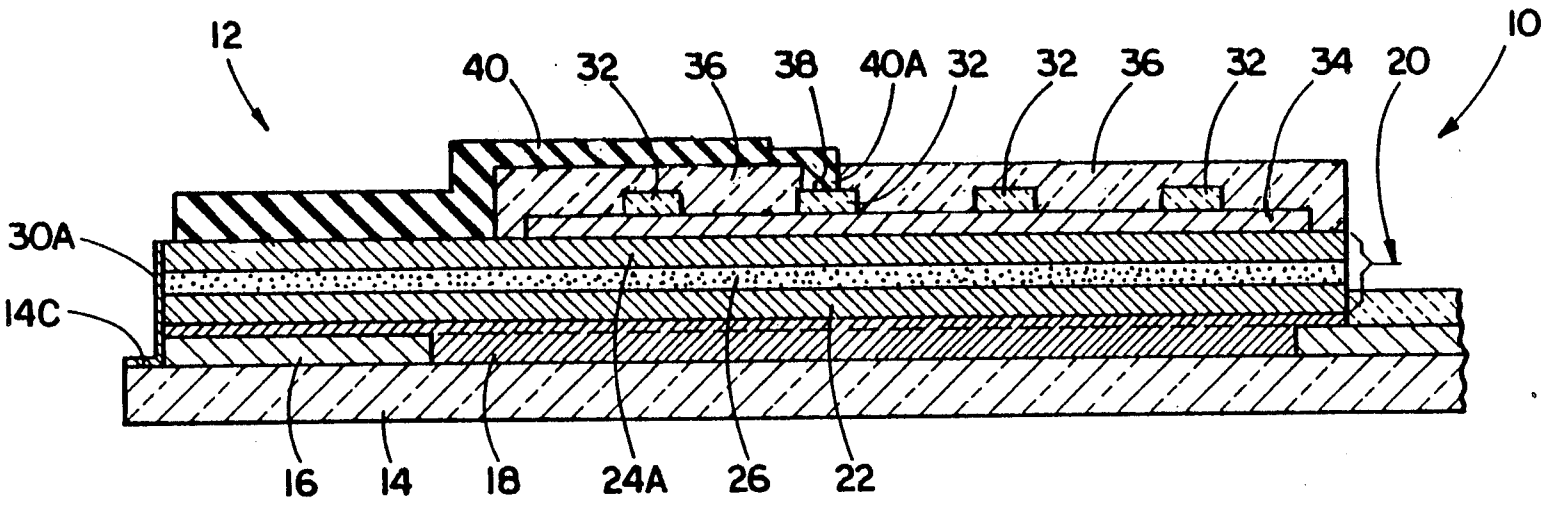
FIG. 77 is a longitudinal cross-sectional view of the completely constructed one embodiment of the TFEL structure taken along line 77—77 in FIG. 68.
Figure 79:
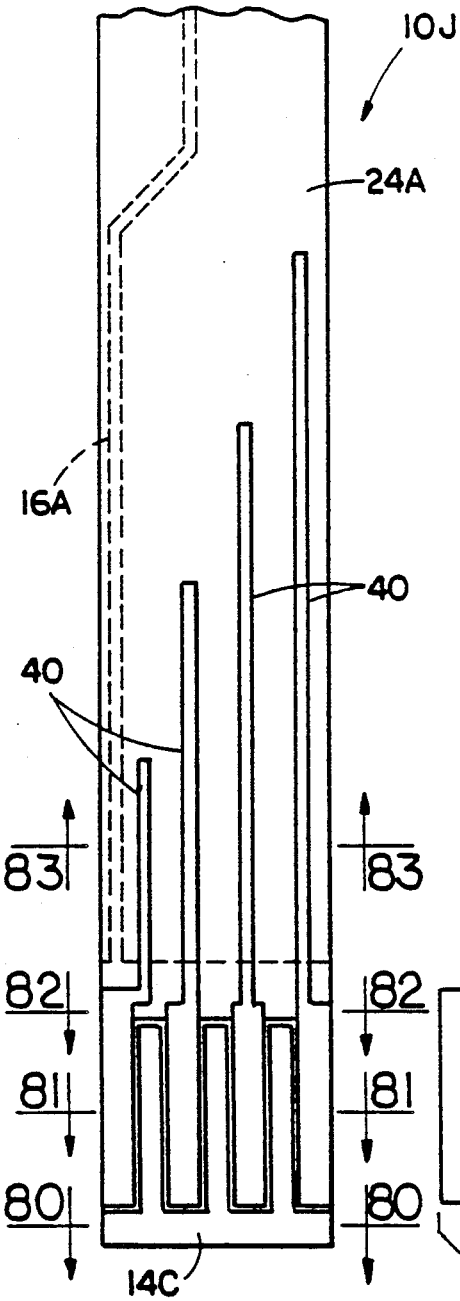
FIG. 79 a fragmentary plan view of a partially constructed TFEL structure illustrating the plurality of control electrodes of FIG. 78 applied over the upper dielectric layer of the EL stack and the corresponding plurality of partially constructed pixels of the partially constructed TFEL structure of FIG. 35.

Referring to FIG. 67, there is illustrated the upper electrode layer for the TFEL structure 10 composed of a plurality of longitudinal control electrodes 40. The control electrodes 40 are preferably made of aluminum material and fabricated by the same photoresist and mask application technique as described earlier. FIGS. 68-77 illustrate one embodiment of the completely constructed TFEL structure 10 with the plurality of control electrodes 40 of FIG. 67 deposited over the upper insulation layer 36 and corresponding partially constructed pixels 30 of the partially constructed TFEL structure 10I of FIG. 60. Also, as best seen in FIG. 75, portions 40A of the upper control electrodes 40 extend downwardly through the holes 38 in the upper insulation layer 36 and make electrical connections with matched portions of the bus bar conductors 32. The opposite ends of the bus bar conductors 32 (not shown) lead to other electronic components not shown. It will be noted in FIG. 68 that the rearward portion 16B of the lower common electrode layer 16 and the plurality of upper control electrodes 40 extend along and overlie separate regions of the bottom substrate layer 14. In such arrangement, none of the upper longitudinal electrodes 40 directly overlie the rearward portion of the lower electrode layer 16. Therefore, electrical isolation is provided and maintained between the upper and lower electrode layers so that the same amount of capacitance will be introduced at each of the pixels 30 of the module 12.

Figure 84:
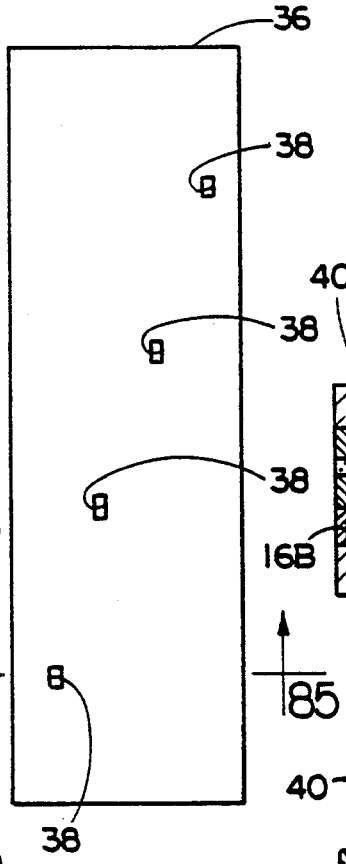
FIG. 84 is a fragmentary plan view of a single insulation of the TFEL structure.
Figure 85:
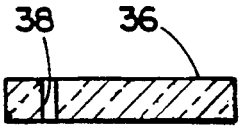
FIG. 85 is a cross-sectional view of the insulation layer taken along line 85—85 in FIG. 84.
Figure 90:
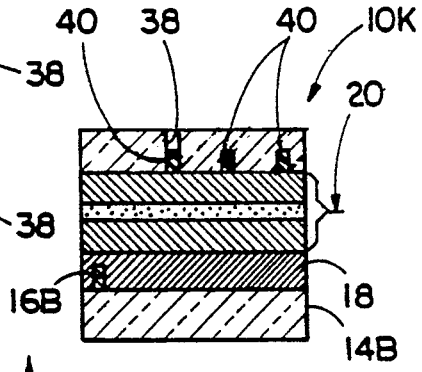
FIGS. 87-90 are different cross-sectional views of the partially constructed TFEL structure of FIG. 86 taken respectively along lines 87—87 to 90—90 in FIG. 86.
Figure 89:
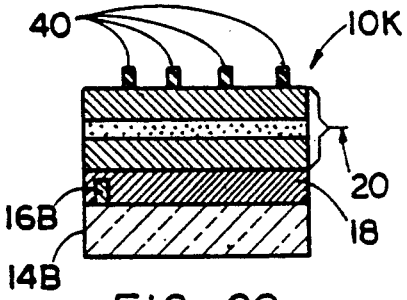
Figure 87:
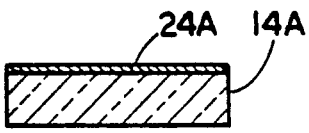
Figure 88:
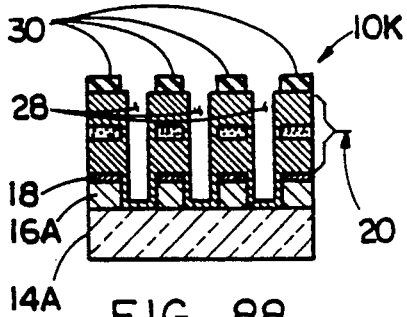
Figure 92:
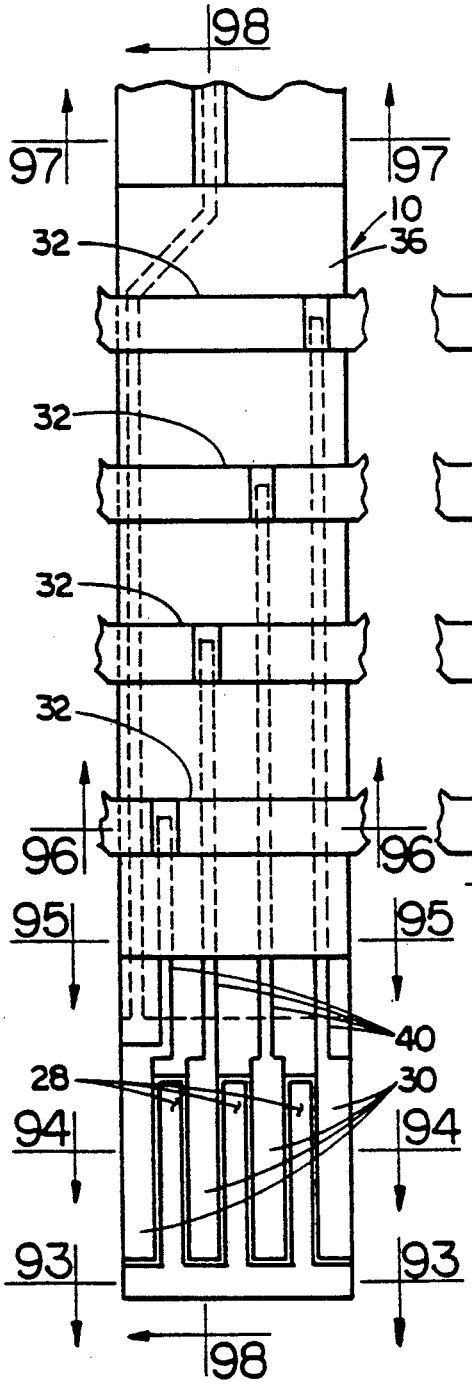
FIG. 92 is a fragmentary plan view of an alternative embodiment of a completely constructed TFEL structure illustrating the series of bus bar connectors of FIG. 91 applied over the insulation layer and plurality of control electrodes of the partially constructed TFEL structure of FIG. 86.
Figure 91:
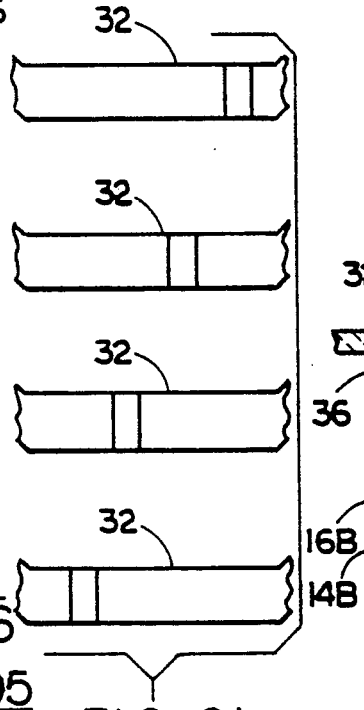
FIG. 91 is a fragmentary plan view of a bus bar layer composed of a series of longitudinally spaced electrical conductors of the TFEL structure.
Figure 96:
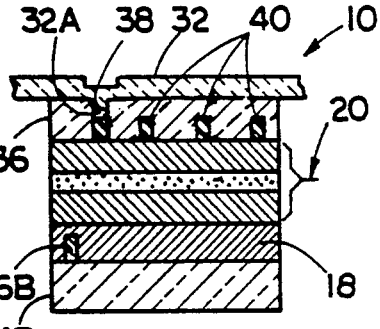
FIGS. 93-97 are different cross-sectional views of the completely constructed alternative embodiment of the TFEL structure of FIG. 92 taken respectively along lines 93—93 to 97-97 in FIG. 92.
Figure 95:
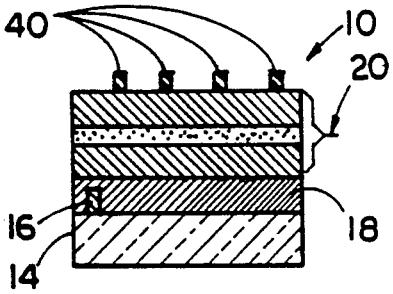
Figure 93:
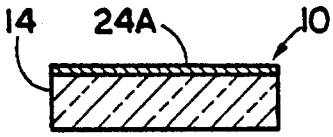
Figure 97:
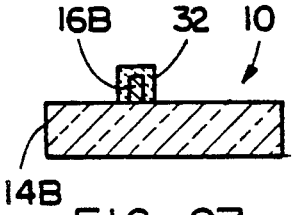
Figure 94:
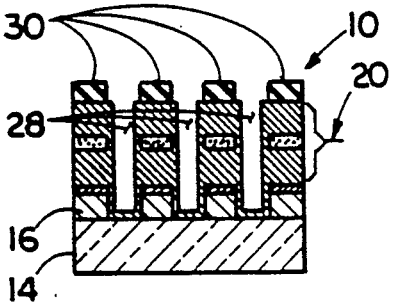
Figure 98:
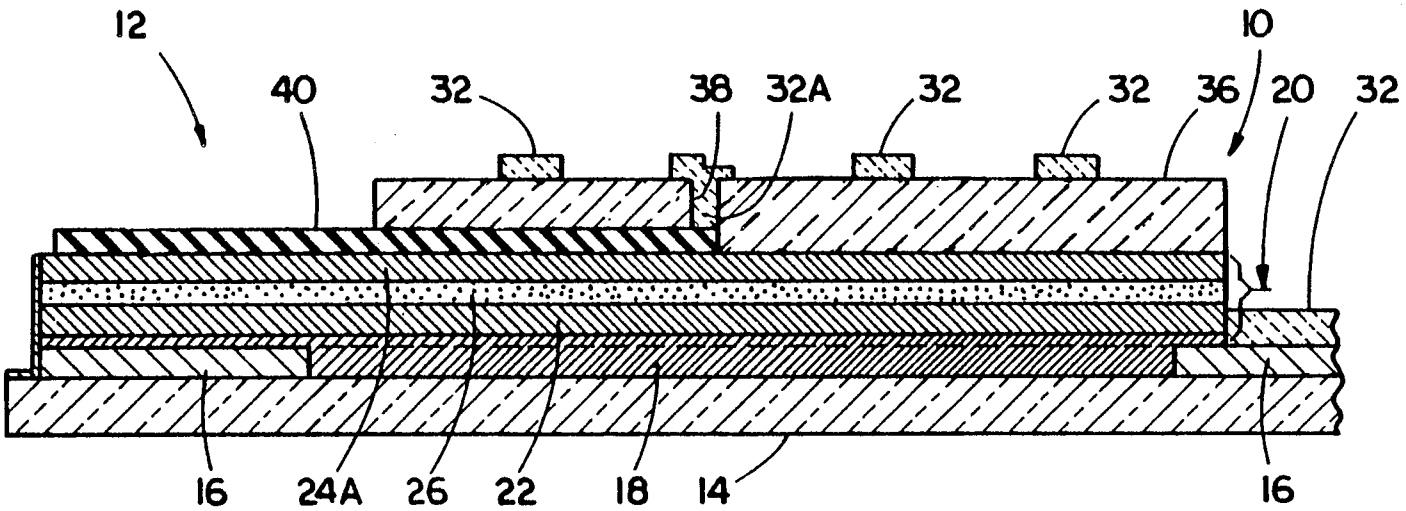
FIG. 98 is a longitudinal cross-sectional view of the completely constructed alternative embodiment of the TFEL structure taken along line 98—98 in FIG. 92.

Referring to FIGS. 78-92, there is illustrated an alternative embodiment of the TFEL structure 10. The only significant difference between this embodiment and the earlier embodiment is that the positions of the bus bar conductors 32 and the upper longitudinal electrodes 40 have been reversed. This eliminates the need for the lower insulation layer 34 of FIGS. 43 and 44. Specifically, FIGS. 79-83 illustrate a partially constructed TFEL structure 10J showing the plurality of control electrodes 40 of FIG. 78 deposited directly over the upper dielectric layer 24A of the EL stack 20 and the corresponding plurality of partially constructed pixels 30 of the partially constructed TFEL structure 1OF of FIG. 35. FIGS. 84 and 85 show the single insulation layer 36 used in the alternative embodiment of the structure. FIGS. 86-90 show a partially completed TFEL structure 10K with the insulation layer 36 of FIG. 84 deposited over the upper control electrodes 40 at the crossover region of the partially completed TFEL structure 10J of FIG. 79. FIG. 91 shows the same bus bar conductors 32 as seen in FIG. 51. FIGS. 92-98 show the completely constructed TFEL structure 10A with the series of bus bar connectors 32 of FIG. 91 deposited over the single insulation layer 36 and the upper control electrodes 40. Now, as best seen in FIG. 96, portions 32A of the bus bar conductors 32 extend downwardly through the holes 38 in the insulation layer 36 and make electrical connections with matched portions of the upper electrodes 40.

Referring to FIGS. 68, 77 92 and 98, the completed multi-layer structure 10 of the tin film electroluminescent edge emitter module 12 includes the elongated bottom substrate layer 14 having a transverse forward edge and a pair of spaced longitudinal side edges extending therefrom, the EL stack 20 overlying a forward portion of the bottom substrate layer 14 and extending between the spaced longitudinal side edges thereof, the lower electrode layer 16 interposed between the bottom substrate layer 14 and the EL stack 20, and the upper electrode layer formed of the plurality of longitudinal control electrodes 40 disposed ahove the EL stack 20. The EL stack 20 includes the lower and upper dielectric layers 22 and 24 interposed between the lower and upper electrode lyers 18, 40, and the middle light-energy generatig layer 26, such as a phosphor layer, interposed between the dielectric layers 22, 24. If desired either one of the lower and upper dielectric layers 22, 24 can be eliminated from the EL stack 20.

A series of longitudinal channels 28 and a transverse street 14C connecting the channels 28 and extending along the forward edge of the bottom substrate layer 14 are constructed on the forward portion of the multi-layer struture 10, and thus are formed through the thickness of the forward portion of the EL stack 20, down to the depth of the bottom substrate layer 14 so as to define the plurality of transversely spaced pixels 30 with front light-emitting edges 30A being setback from the forward edge of the bottom substrate layer 14 by the width of the transverse street 14C. The upper dielectric layer 24 sealably covers the light-energy generating layer 26 and the front-facing and side-facing walls 30A, 30B (FIGS. 35, 37, 41 and 42) thereof defining the channels 28 as well as the portions of the bottom substrate layer 14 exposed in the channels so as to sealably encapsulate the forward portion of the lower electrode layer 16 and the EL stack light-energy generating layer 26 upon the bottom substrate layer 14.

The forward portion of the lower electrode layer 16 includes transversely spaced longitudinal elements 16A which are coextensive in length and width with the longitudinal pixels 30 of the forward portion of the active EL stack 20. The rearward portion 16B of the lower electrode layer 16 is coextensive in length with the rearward portion of the bottom substrate layer 14 but is of a width only a fraction of that of the rearward portion of the substrate layer 14 and extends only along one longitudinal side edge portion thereof. The longitudinal control electrodes 40 of the upper electrode layer overlie the EL stack 20 and the pixels 30 thereof as well as the forward portion of the lower electrode layer 14 underlying the EL stack 20; however, the rearward portions of the upper control electrodes 40 do not overlie the rearward portion of the lower electrode layer.

The multi-layer structure 10 also includes the bus bar layer and the upper insulating layer 36. The bus bar layer is composed of the series of longitudinally spaced transverse electrical conductors 32 either overlying or underlying the rearward portions of the upper control electrodes 40. The insulating layer 36 is interposed between the bus bar conductors 32 and the upper control electroes 40. Selected portions of the bus bar conductors 32 and upper control electrodes 40 make electrical connections with one another.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

We claim:

1. A multi-layer structure for providing a thin film electroluminescent edge emitter module, comprising:

(a) a bottom substrate layer having a forward edge;

(b) an electroluminescent (EL) stack overlying said bottom substrate layer and having a forward portion;

(c) a lower electrode layer interposed between said bottom substrate layer and said EL stack and having a forward portion, said forward portions of said EL stack and lower electrode layer having formed therethrough to the depth of said bottom substrate layer a series of longitudinal channels and a transverse street connecting said channels and extending along said forward edge of said bottom substrate layer so as to define a plurality (d) an upper electrode layer having a forward portion composed of a plurality of transversely spaced longitudinal electrodes, said longitudinal electrodes of said forward portion of said upper electrode layer overlying said longitudinal elements of said forward portions of said EL stack and lower electrode layer so as to define therewith a plurality of pixels having light-emitting front edges which are setback from said forward edge of said bottom substrate layer by the width of said street.

2. The structure as recited in claim 1, wherein said EL stack includes at least one dielectric layer interposed between said lower and upper electrode layers.

3. The structure as recited in claim 2, wherein said EL stack further includes a light-energy generating layer interposed between said one dielectric layer and said lower or upper electrode layer.

4. The structure as recited in claim 3, wherein said light-energy generating layer is a phosphor layer.

5. A multi-layer structure for providing a thin film electroluminescent edge emitter module, comprising:

(a) a bottom substrate layer;

(b) an electroluminescent (EL) stack overlying said bottom substrate layer and having a forward portion; and (c) a lower electrode layer interposed between said bottom substrate layer and said EL stack and having a forward portion, said forward portions of said EL stack and lower electrode layer having a plurality of transversely spaced longitudinal elements formed by alternately longitudinally spaced front-facing walls and transversely spaced side-facing walls interconnecting said front-facing walls and defining to the depth of said bottom substrate layer a plurality of transversely spaced longitudinal channels between said longitudinal elements;

(d) said EL stack including a light-energy generating layer overlying said lower electrode layer and a dielectric layer overlying said light-energy generating layer, said dielectric layer sealably covering said light-energy generating layer, said front-facing and side-facing walls of said longitudinal elements, and portions of said bottom substrate layer exposed in said channels so as to sealably encapsulate said forward portions of said lower electrode layer and said EL stack light-energy generating layer upon said bottom substrate layer.

6. The structure as recited in claim 5, further comprising:

an upper electrode layer having a forward portion composed of a plurality of transversely spaced longitudinal electrodes, said longitudinal electrodes of said forward portion of said upper electrode layer overlying said longitudinal elements of said forward portions of said EL stack and lower electrode layer so as to define therewith a plurality of pixels having light-emitting front edges.

7. The structure as recited in claim 5, wherein said EL stack also includes another dielectric layer interposed between said light-energy generating layer and said lower electrode layer.

8. A multi-layer structure for providing a thin film electroluminescent edge emitter module, comprising:

(a) a bottom substrate layer;

(b) a lower electrode layer overlying said bottom substrate layer and including a rearward portion and a forward portion, said rearward portion of said lower electrode layer occupying a first region but not a second region on said bottom substrate layer;

(c) an electroluminescent (EL) stack overlying said bottom substrate layer and said lower electrode layer thereon; and (d) an upper electrode layer composed of a plurality of transversely spaced longitudinal electrodes having rearward portions and forward portions, said rearward electrode portions of said upper electrode layer overlying only the section of said rearward portion of said EL stack that, in turn, overlies said second region on said bottom substrate layer not occupied by said rearward portion of said lower electrode layer such that electrical isolation is thereby provided between said rearward portions of said lower and upper electrode layers.

9. The structure as recited in claim 8, wherein:

said EL stack has a forward portion with a plurality of transversely spaced elements having front light-emitting edges defined thereon; and said forward portion of said lower electrode layer has transversely spaced electrode elements located between and substantially coextensive with said bottom substrate layer and said spaced elements of said EL stack forward portion.

10. The structure as recited in claim 9, wherein said forward portions of said longitudinal electrodes of said upper electrode layer overlie said longitudinal elements of said forward portions of said EL stack and lower electrode layer.

11. The structure as recited in claim 8, further comprising:

a filler layer interposed between said bottom substrate layer and said EL stack and occupying said second region on said bottom substrate layer.

12. The structure as recited in claim 11, wherein said filler layer is an adhesive.

13. The structure as recited in claim 8, wherein said first region on said bottom substrate layer is substantially narrower than said second region thereon.

14. The structure as recited in claim 8, wherein said bottom substrate layer and said EL stack having respective corresponding pairs of opposite longitudinally extending side edges, said first region on said bottom substrate layer and said rearward portion of said lower electrode layer occupying said first region on said bottom substrate layer extending along one of said pairs of longitudinal side edges of said bottom substrate layer and said EL stack.

15. The structure as recited in claim 8, further comprising:

a bus bar layer composed of a series of longitudinally spaced transverse electrical conductors overlying said rearward portion of said EL stack and crossing said rearward portions of said longitudinal electrodes of said upper electrode layer.

16. The structure as recited in claim 15, further comprising:

an insulation layer interposed between said bus bar layer and said upper electrode layer, one of said bus bar layer and said upper electrode layer overlying the other with said insulation layer located therebetween.

17. A multi-layer structure for providing a thin film electroluminescent edge emitter module, comprising:

(a) a bottom substrate layer;

(b) an electroluminescent (EL) stack overlying said bottom substrate layer and including a rearward portion and a forward portion;

(c) a lower electrode layer interposed between said bottom substrate layer and said EL stack, said lower electrode layer including a rearward portion and a forward portion being located respectively between said bottom substrate layer and said EL stack rearward and forward portions;

(d) an upper electrode layer composed of a plurality of transversely spaced longitudinal electrodes having rearward portions and forward portions, said rearward and forward electrode portions of said upper electrode layer overlying respectively said rearward and forward portions of said EL stack;

(e) a bus bar layer composed of a series of longitudinally spaced transverse electrical conductors overlying said rearward portion of said EL stack and crossing said rearward portions of said longitudinal electrodes of said upper electrode layer; and (f) an insulation layer interposed between said bus bar layer and said rearward electrode portions of said upper electrode layer, one of said bus bar layer and upper electrode layer overlying the other with said insulation layer located therebetween, selected portions of said one of said bus bar layer and upper electrode layer extending through said insulation layer and making electrical connections with selected portions of said other of said bus bar layer and upper electrode layer.

18. The structure as recited in claim 17, wherein said bus bar layer overlies said rearward electrode portions of said upper electrode layer with said insulation layer located therebetween and selected portions of said bus bar layer extending through said insulation layer and making electrical connections with selected portions of said upper electrode layer.

19. The structure as recited in claim 17, wherein said rearward electrode portions of said upper electrode layer overlies said bus bar layer with said insulation layer located therebetween and selected portions of said upper electrode layer extending through said insulation layer and making electrical connections with selected portions of said bus bar layer.

20. A multi-layer structure for providing a thin film electroluminescent edge emitter module, comprising:

(a) an elongated bottom substrate layer having a transverse forward edge and a pair of spaced longitudinal side edges extending therefrom;

(b) an electroluminescent (EL) stack overlying said bottom substrate layer and extending between said spaced longitudinal side edges thereof, said EL stack including a rearward portion and a forward portion, said forward portion having formed therethrough to the depth of said bottom substrate layer a series of longitudinal channels and a transverse street connecting said channels and extending along said forward edge of said bottom substrate layer so as to define a plurality of transversely spaced elements having front light-emitting edges being setback from said forward edge of said bottom substrate layer by the width of said street;

(c) a lower electrode layer interposed between said bottom substrate layer and said EL stack and including a forward portion having transversely spaced longitudinal elements coextensive in length and width with said longitudinal elements of said forward portion of said active EL stack, said lower electrode layer also including a rearward portion being coextensive in length with a rearward portion of said substrate layer but of a width only a fraction of that of said rearward portion of said substrate layer and extending only along one longitudinal side edge portion thereof;

(d) an upper electrode layer composed of a plurality of transversely spaced longitudinal control electrodes overlying said rearward portion of said EL stack and said longitudinal elements of said forward portion thereof such that none of said longitudinal control electrodes overlie said rearward portion of said lower electrode layer;

(e) a bus bar layer composed of a series of longitudinally spaced transverse electrical conductors overlying said rearward portion of said EL stack and said rearward portion of said lower electrode layer; and (f) an insulation layer interposed between said bus bar layer and said upper electrode layer, one of said bus bar layer and said upper electrode layer overlying the other with said insulation layer located therebetween, selected portions of said one of said bus bar layer and upper electrode layer extending through said insulation layer and making electrical connections with selected portions of said other of said bus bar layer and upper electrode layer.

21. A method of constructing a multi-layer structure for providing a thin film electroluminescent edge emitter module, said method comprising the steps of:

(a) depositing and etching a lower electrode layer over a bottom substrate layer;

(b) depositing an electroluminescent (EL) stack over the lower electrode layer; and (c) etching a series of longitudinal channels and a transverse street connecting the channels and extending along a forward edge of the bottom substrate layer in forward portions of the EL stack and lower electrode layer so as to define a plurality of transversely spaced longitudinal elements on the forward portions of the EL stack and lower electrode layer having front light-emitting edges setback from the forward edge of the bottom substrate layer by the width of the street.

22. The method as recited in claim 21, further comprising the step of:

depositing and etching an upper electrode layer composed of a plurality of transversely spaced longitudinal electrodes over the EL stack with a forward portion of the longitudinal electrodes overlying the longitudinal elements on the forward portions of the EL stack and lower electrode layer.

23. A method of constructing a multi-layer structure for providing a thin film electroluminescent edge emitter module, said method comprising the steps of:

(a) depositing and etching a lower electrode layer over a bottom substrate layer;

(b) depositing an electroluminescent (EL) stack over the electrode layer, said EL stack including a light-energy generating layer overlying the lower electrode layer and a dielectric layer overlying the light-energy generating layer;

(c) etching the EL stack and lower electrode layer to define a plurality of transversely spaced longitudinal elements on forward portions of the EL stack and lower electrode layer, said longitudinal elements having alternately longitudinally spaced front-facing walls and transversely spaced side-facing walls interconnecting said front-facing walls which define to teh depth of the bottom substrate layer a plurality of transversely spaced longitudinal channels between the longitudinal elements;

(d) removing the original dielectric layer of the EL stack from the light-energy generating layer thereof; and (e) depositing a new dielectric layer over the light-energy generating layer of the EL stack and sealably covering the light-energy generating layer, the front-facing and side-facing walls of the longitudinal elements, and portions of the bottom substrate layer exposed in the channels so as to thereby sealably encapsulate the forward portions of the EL stack light-energy generating layer and the lower electrode layer upon the bottom substrate layer.

24. The method as recited in claim 23, further comprising the step of:

depositing and etching an upper electrode layer composed of a plurality of transversely spaced longitudinal electrodes over the EL stack with a forward portion of the longitudinal electrodes overlying the longitudinal elements on the forward portions of the EL stack and lower electrode layer.

25. A method of constructing a multi-layer structure for providing a thin film electroluminescent edge emitter module, said method comprising the steps of:

(a) depositing and etching a lower electrode layer over a bottom substrate layer such that a rearward portion of the lower electrode layer occupies a first region but not a second region on the bottom substrate layer;

(b) depositing an electroluminescent (EL) stack over the bottom substrate layer and the lower electrode layer thereon; and (c) depositing and etching an upper electrode layer over the EL stack such that a rearward portion of the upper electrode layer overlies only the section of said EL stack that, in turn, overlies the second region on the bottom substrate layer not occupied by the rearward portion of the lower electrode layer to thereby provide electrical isolation between the rearward portions of the lower and upper electrode layers.

26. A method of constructing a multi-layer structure for providing a thin film electroluminescent edge emitter module, said method comprising the steps of:

(a) depositing and etching a lower electrode layer over a bottom substrate layer;

(b) depositing an electroluminescent (EL) stack over the lower electrode layer;

(c) depositing and etching an upper electrode layer over the EL stack;

(d) depositing an insulation layer over the upper electrode layer; and (e) depositing and etching a bus bar layer over the insulation layer such that the bus bar layer overlies the upper electrode layer with the insulating layer located therebetween and selected portions of the bus bar layer extending through the insulation layer and making electrical connections with selected portions of the upper electrode layer.

27. A method of constructing a multi-layer structure for providing a thin film electroluminescent edge emitter module, said method comprising the steps of:

(a) depositing and etching a lower electrode layer over a bottom substrate layer;

(b) depositing an electroluminescent (EL) stack over the lower electrode layer;

(c) depositing and etching a bus bar layer over the EL stack;

(d) depositing an insulation layer over the bus bar layer; and (e) depositing and etching an upper electrode layer over the insulation layer such that the upper electrode layer overlies the bus bar layer with the insulation layer located therebetween and selected portions of the upper electrode layer extending through the insulation layer and making electrical connections with selected portions of the bus bar layer.

* * * * *